US012391438B2

(12) United States Patent
Massucco

(10) Patent No.: US 12,391,438 B2
(45) Date of Patent: Aug. 19, 2025

(54) CAP ASSEMBLIES AND DRINK CONTAINERS INCLUDING THE SAME

(71) Applicant: HydraPak LLC, Oakland, CA (US)

(72) Inventor: Michael Ross Massucco, Oakland, CA (US)

(73) Assignee: HydraPak LLC, Oakland, CA (US)

( * ) Notice: Subject to any disclaimer, the term of this patent is extended or adjusted under 35 U.S.C. 154(b) by 0 days.

(21) Appl. No.: 17/837,471

(22) Filed: Jun. 10, 2022

(65) Prior Publication Data

US 2022/0396401 A1 Dec. 15, 2022

Related U.S. Application Data

(60) Provisional application No. 63/209,275, filed on Jun. 10, 2021.

(51) Int. Cl.
*B65D 47/06* (2006.01)
*B65D 47/20* (2006.01)
*B65D 53/02* (2006.01)

(52) U.S. Cl.
CPC ..... *B65D 47/065* (2013.01); *B65D 47/2018* (2013.01); *B65D 53/02* (2013.01)

(58) Field of Classification Search
CPC ..... B65D 47/2018; B65D 53/02; B65D 75/5877; B65D 47/065; B65D 47/141; B65D 51/18
USPC ..... 220/254.2
See application file for complete search history.

(56) References Cited

U.S. PATENT DOCUMENTS 4,717,050 A * 1/1988 Wright ..... B65D 47/0885 220/259.2
5,094,363 A * 3/1992 Monahan ..... A45F 3/20 222/523
5,316,387 A 5/1994 Polett et al.
6,076,967 A 6/2000 Beaudette
6,076,968 A 6/2000 Smith et al.
6,382,476 B1 * 5/2002 Randall ..... B65D 47/0885 220/259.2
7,490,740 B2 2/2009 Robins et al.
9,480,323 B2 11/2016 Lyon et al.
(Continued)

OTHER PUBLICATIONS

HydraPak Catalog, "Hydration Gear Spring 2018," published Jan. 2018.

*Primary Examiner* — Bob Zadeh
(74) *Attorney, Agent, or Firm* — KOLITCH ROMANO DASCENZO GATES LLC

(57) ABSTRACT

Cap assemblies and drink containers including the same. The cap assemblies include a base portion that sealingly mates with a neck of a liquid vessel and includes a base opening, a cover portion including a drink outlet and pivotally coupled to the base portion to selectively transition the cover portion between closed and open configurations. When the cover portion is in the closed configuration with the cap assembly coupled to the liquid vessel, the cover portion channels liquid through the base opening to the drink outlet and restricts liquid from being dispensed from the cap assembly other than through the drink outlet. When the cover portion is in the open configuration with the cap assembly coupled to the liquid vessel, the cover portion is pivoted away from the base portion and permits liquid to be dispensed from the cap assembly through the base opening without passing through the drink outlet.

16 Claims, 12 Drawing Sheets

(56) References Cited

U.S. PATENT DOCUMENTS

| | | | | |
|---|---|---|---|---|
| 9,833,057 | B2 | 12/2017 | Lyon et al. | |
| D817,632 | S | 5/2018 | Lyon et al. | |
| 10,390,604 | B2 | 8/2019 | Lyon et al. | |
| 10,517,377 | B2 | 12/2019 | Lyon et al. | |
| 10,897,980 | B2 | 1/2021 | Lyon et al. | |
| 11,134,768 | B2 | 10/2021 | Hoskins | |
| 2004/0169045 | A1* | 9/2004 | Giraud | B65D 43/162 220/717 |
| 2009/0242587 | A1 | 10/2009 | Bemis | |
| 2010/0102022 | A1* | 4/2010 | Kuwahara | B65D 47/0838 215/235 |
| 2012/0241454 | A1* | 9/2012 | Dennis | B65D 51/18 220/259.2 |
| 2013/0306635 | A1* | 11/2013 | Crevin | A47G 23/0258 220/254.2 |
| 2016/0068313 | A1* | 3/2016 | Hart | B65D 43/169 220/254.2 |
| 2017/0320640 | A1* | 11/2017 | Steinmann | B65D 53/02 |
| 2020/0229579 | A1* | 7/2020 | Rajan | B65D 35/10 |
| 2021/0323737 | A1* | 10/2021 | Gross | B65D 51/18 |
| 2022/0015529 | A1 | 1/2022 | Hoskins et al. | |
| 2022/0396401 | A1* | 12/2022 | Massucco | B65D 47/2018 |

* cited by examiner

CAP ASSEMBLIES AND DRINK CONTAINERS INCLUDING THE SAME

RELATED APPLICATION

This application claims priority to similarly titled U.S. Provisional Patent Application No. 63/209,275, which was filed on Jun. 10, 2021 and the complete disclosure of which is hereby incorporated by reference.

FIELD OF THE DISCLOSURE

The present disclosure is directed generally to drink containers, and more particularly to cap assemblies thereof.

BACKGROUND OF THE DISCLOSURE

Drink containers for carrying a volume of potable drink liquid often include a liquid vessel, which is configured to contain a volume of potable drink liquid and a cap assembly that is removably coupled to the liquid vessel. In many examples, the cap assembly includes a drink outlet, such as a valved outlet, for dispensing the potable drink liquid. Such drink outlets typically are unsuitable for refilling the liquid vessel via the drink outlet. Accordingly, in many prior art examples of drink containers with removable cap assemblies, it generally is preferred and/or necessary to partially or fully remove the cap assembly from the liquid vessel to refill the liquid vessel with the potable drink liquid, such as via the neck of the liquid vessel. Removing and reattaching these cap assemblies in this manner usually requires two hands, being that the user often must hold the liquid vessel with one hand while using the other hand to disengage or reengage the cap assembly. Moreover, a user often must properly index the cap assembly with the neck of the liquid vessel when reattaching the cap assembly after refilling the liquid vessel, which requires attention and some level of dexterity. This process can cause problems and/or be time consuming in circumstances in which the user's hands are numb and/or experiencing reduced dexterity, for example, during a running race.

SUMMARY

Cap assemblies and drink containers including the cap assemblies are disclosed herein. The cap assemblies include a base portion that is configured to be selectively coupled to a neck of a liquid vessel to sealingly mate with the neck of the liquid vessel. The base portion includes a base opening. The cap assemblies further include a cover portion that includes a drink outlet. The cover portion is pivotally coupled to the base portion to selectively transition the cover portion between a closed configuration and an open configuration. When the cover portion is in the closed configuration with the cap assembly operatively coupled to the liquid vessel, the cover portion is configured to channel liquid to flow from the internal compartment through the base opening and to the drink outlet. When the cover portion is in the closed configuration with the cap assembly operatively coupled to the liquid vessel, the cover portion restricts liquid from being dispensed from the cap assembly through the base opening other than through the drink outlet. When the cover portion is in the open configuration with the cap assembly operatively coupled to the liquid vessel, the cover portion is pivoted away from the base portion and permits liquid to be dispensed from the cap assembly through the base opening and without passing through the drink outlet. The liquid vessel includes a neck with a neck opening and an internal compartment configured to hold a volume of potable drink liquid.

DETAILED DESCRIPTION

FIGS. 1-12 illustrate examples of cap assemblies 100 and drink containers 10 comprising cap assemblies 100 according to the present disclosure. Elements that serve a similar, or at least substantially similar, purpose are labeled with like numbers in each of FIGS. 1-12, and these elements may not be discussed in detail herein with reference to each of FIGS. 1-12. Similarly, all elements may not be labeled in each of FIGS. 1-12, but reference numbers associated therewith may be utilized herein for consistency. Elements, components, and/or features that are discussed herein with reference to one or more of FIGS. 1-12 may be included in and/or utilized with the subject matter of any of FIGS. 1-12 without departing from the scope of the present disclosure.

In general, elements that are likely to be included in a given (i.e., a particular) embodiment are illustrated in solid lines, while elements that are optional to a given embodiment are illustrated in dash-dot lines. However, elements that are shown in solid lines are not essential to all embodiments, and an element shown in solid lines may be omitted from a given embodiment without departing from the scope of the present disclosure. Dot-dashed lines are utilized to indicate various virtual features (e.g., dimensions, directions, etc.), and these virtual features may or may not be optional to the illustrated embodiment.

Figure 1:
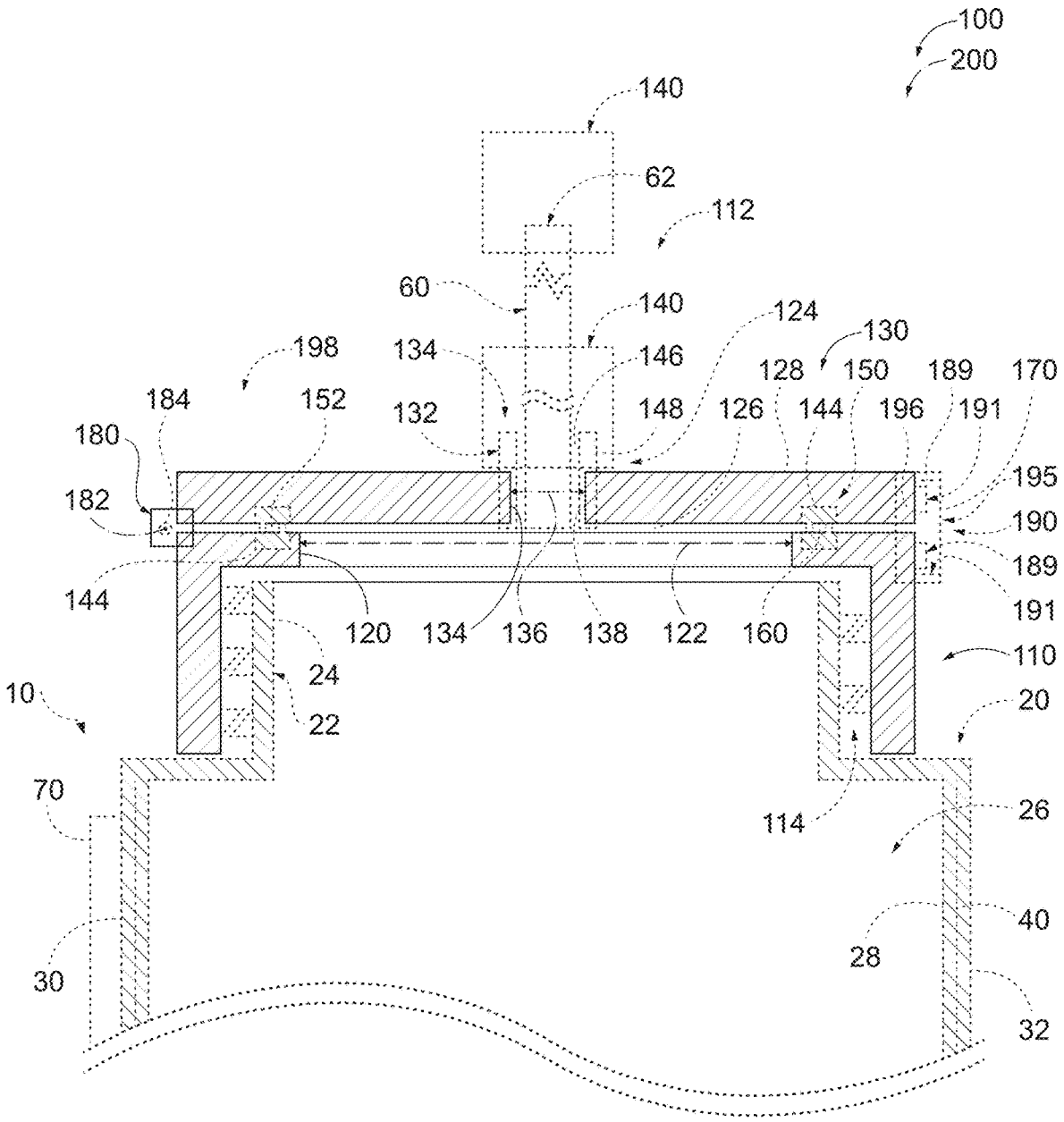
FIG. 1 is a schematic fragmentary cross-sectional side elevation view representing examples of cap assemblies with a cover portion in a closed configuration according to the present disclosure.
Figure 2:
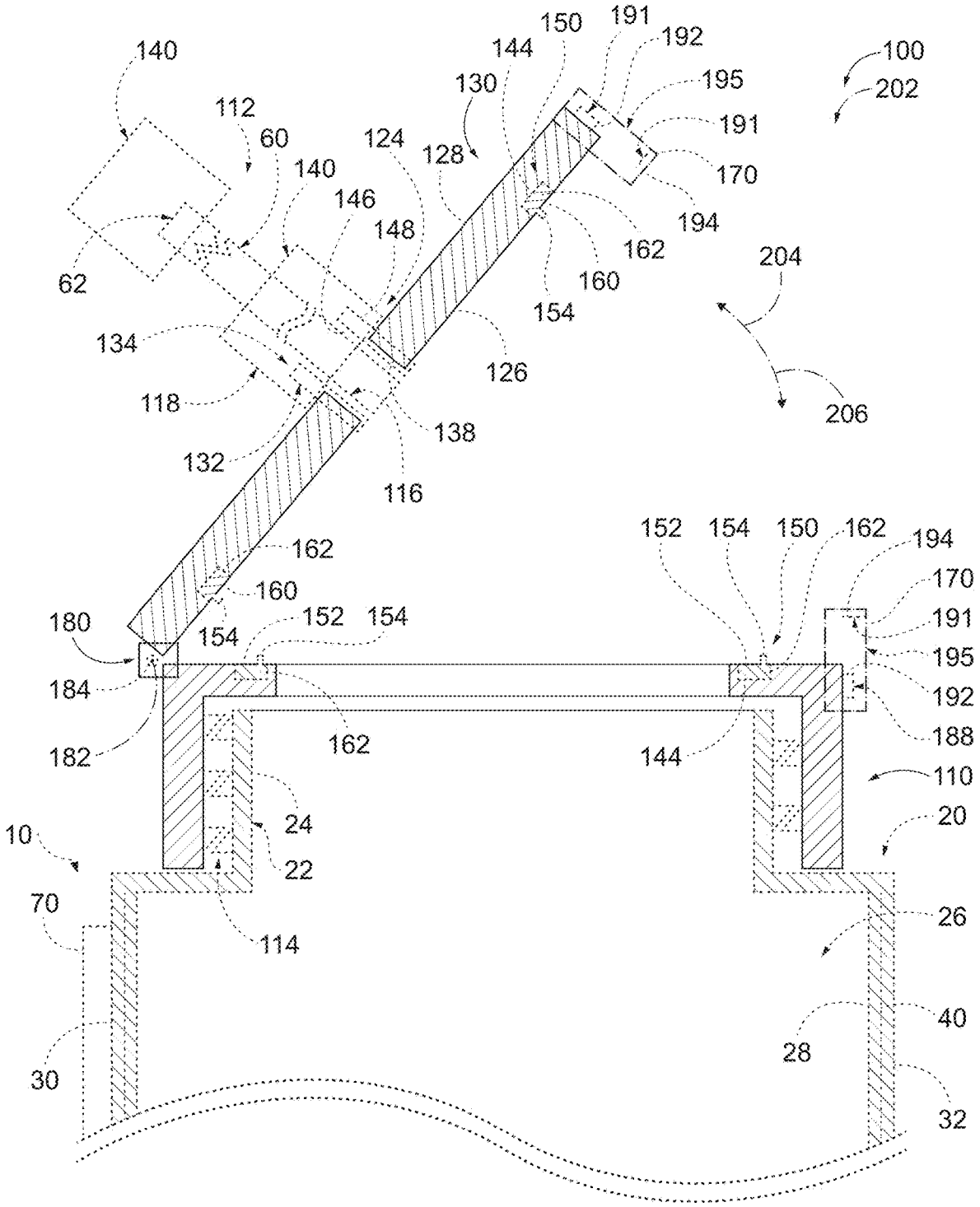
FIG. 2 is a schematic fragmentary cross-sectional side elevation view representing examples of cap assemblies with the cover portion in an open configuration according to the present disclosure.

FIGS. 1-2 schematically represent examples of cap assemblies 100 and drink containers 10 that include cap assemblies 100. As shown, drink containers 10 include cap assembly 100 and a liquid vessel 20. Liquid vessel 20 includes a neck 22 with a neck opening 24, and liquid vessel 20 further includes an internal compartment 26 that is configured to hold a volume of potable drink liquid. Non-exclusive examples of potable drink liquids that may be used in drink containers 10 according to the present disclosure include water, juice, sport drinks, soft drinks, and the like.

Cap assembly 100 is configured to be selectively coupled to liquid vessel 20 such that the potable drink liquid may be dispensed from internal compartment 26 via cap assembly 100. In particular, cap assembly 100 includes a base portion 110 configured to be selectively coupled to neck 22 of liquid vessel 20, such as to sealingly mate with the neck of liquid vessel 20. Base portion 110 includes a base opening 120 such that the potable drink liquid from internal compartment 26 may flow into cap assembly 100 via neck opening 24 and base opening 120. When cap assembly 100 sealingly mates with neck 22 of liquid vessel 20, potable drink liquid within internal compartment 26 may flow from the internal compartment into the cap assembly via neck opening 24 and base opening 120 without leaking from the internal compartment between neck 22 and base portion 110.

Base portion 110 further comprises a cover portion 130 that includes a drink outlet 134 through which the potable drink liquid may be dispensed from the cover portion. Cover portion 130 is pivotally coupled to base portion 110 to selectively transition the cover portion between a closed configuration 200 (such as schematically illustrated in FIG. 1) and an open configuration 202 (such as schematically illustrated in FIG. 2). Cover portion 130 may be pivotally coupled to base portion 110 via any suitable mechanism, linkage, or other physical connection. As discussed in more detail herein, an example of such a suitable structure is a hinge, but others may be utilized. As used herein, the open and closed configurations of the cover portion additionally or alternatively may be referred to as the open and closed configurations of cap assembly 100 and/or of drink container 10.

Examples of cap assemblies 100 with cover portion 130 in the closed and open configurations are schematically illustrated in FIGS. 1 and 2, respectively. As shown in FIG. 1, when cover portion 130 is in closed configuration 200 with cap assembly 100 operatively coupled to liquid vessel 20, the cover portion is configured to channel liquid to flow from internal compartment 26 through base opening 120 and to drink outlet 134. As also shown in FIG. 1, when cover portion 130 is in closed configuration 200 with cap assembly 100 operatively coupled to liquid vessel 20, the cover portion restricts liquid from being dispensed from the cap assembly through base opening 120 other than through drink outlet 134. In contrast, and as shown in FIG. 2, when cover portion 130 is in open configuration 202 with cap assembly 100 operatively coupled to liquid vessel 20, the cover portion is pivoted away from base portion 110 and permits liquid to be dispensed from the cap assembly through base opening 120 and without passing through drink outlet 134. Stated differently, in the closed configuration, cap assembly 100 is configured such that the potable drink liquid sequentially passes through base opening 120 and drink outlet 134 when the potable drink liquid is dispensed from drink container 10 via drink outlet 134, but not when the cap assembly is in the open configuration. In the closed configuration, cover portion 130 additionally or alternatively may be described as being pivoted away from base opening 120, and due to the pivotal connection between the base portion and the cover portion, complete separation of these components is not required.

Cap assemblies 100 further may include a hinge 180 that operatively couples cover portion 130 to base portion 110 such that cover portion 130 is configured to pivot relative to base portion 110. In particular, hinge 180 may be configured to permit cover portion 130 to pivot relative to base portion 110, about hinge 180, to transition cover portion 130 between closed configuration 200 and open configuration 202. In some examples, hinge 180 couples cover portion 130 to base portion 110 such that cover portion 130 is configured to pivot relative to base portion 110 about a pivot axis 182, which may extend through hinge 180.

When cover portion 130 is in the closed configuration 200, cover portion 130 additionally or alternatively may be described as at least partially restricting liquid from being dispensed from cap assembly 100 through base portion 110 via base opening 120. Stated differently, when cover portion 130 is in closed configuration 200 with cap assembly 100 operatively coupled to liquid vessel 20, cover portion 130 at least substantially covers base opening 120 such that liquid is restricted to being dispensed from liquid vessel 20 only through both of base portion 110 and cover portion 130. More specifically, when cover portion 130 is in the closed configuration with cap assembly 100 operatively coupled to liquid vessel 20, the cover portion may operate to restrict the potable drink liquid from being introduced into or dispensed from liquid vessel 20 other than via drink outlet 134.

When cover portion 130 is in open configuration 202, at least a portion of the cover portion is spaced apart from base portion 110 to permit liquid to flow through the base portion via base opening 120 and without passing through drink outlet 134. More specifically, when cover portion 130 is in open configuration 202 with cap assembly 100 operatively coupled to liquid vessel 20, cover portion 130 is pivoted away from base portion 110 so as to permit the potable drink liquid to be introduced into or dispensed from liquid vessel 20 via base opening 120 without flowing through drink outlet 134. In this manner, cap assembly 100 enables the potable drink liquid to be dispensed via drink outlet 134 when cover portion 130 is in closed configuration 200, and cap assembly 100 enables the potable drink liquid to be introduced into and/or dispensed from liquid vessel 20 rapidly via base opening 120 when cover portion 130 is in the open configuration.

Accordingly, cap assemblies 100 according to the present disclosure may permit liquid vessel 20 to be filled or refilled with the potable drink liquid while cap assembly 100 remains operatively coupled to neck 22. As discussed in more detail herein, cap assembly 100 may be configured such that cover portion 130 can be transitioned between closed configuration 200 and open configuration 202 in a single-handed operation. This is unlike many prior art drink containers where it is generally necessary to remove the cap assembly from the liquid vessel to refill the liquid vessel, and removal of the cap assembly from the liquid vessel typically requires two hands.

In some examples, the respective roles and/or functionalities of base opening 120 and of drink outlet 134 may be characterized with reference to respective dimensions thereof. For example, and as schematically illustrated in FIG. 1, base opening 120 may be characterized in terms of a base opening diameter 122 thereof, and drink outlet 134 may be characterized in terms of a drink outlet diameter 136 thereof. Accordingly, a ratio of base opening diameter 122 to drink outlet diameter 136 may at least partially characterize a typical, or maximum, flow rate of the potable drink liquid through base opening 120 relative to that through drink outlet 134. For example, configuring cap assembly 100 such that base opening diameter 122 is greater than drink outlet diameter 136 may enhance a capacity of cap assembly 100 to accept the potable drink liquid into liquid vessel 20 via base opening 120 at a faster rate than a rate at which the potable drink liquid may flow through drink outlet 134. The ratio of base opening diameter 122 to drink outlet diameter 136 thus may be any of a variety of ratios that correspond to and/or enable this increased flow capacity, examples of which include at least 1.5:1, at least 2:1, at least 2.5:1, at least 3:1, at least 3.5:1, at least 4:1, at least 4.5:1, at most 5:1, at most 4.25:1, at most 3.75:1, at most 3.25:1, at most 2.75:1, at most 2.25:1, and/or at most 1.75:1.

Cover portion 130 may include and/or support any of a variety of structures and/or components to define and/or interface with drink outlet 134. In some examples, cover portion 130 includes an outlet spout 132 that extends away from base portion 110 when cover portion 130 is in the closed configuration 200 and that at least partially defines drink outlet 134. In some such examples, outlet spout 132 is at least substantially cylindrical. However, this is not required of all examples of cap assembly 100, and it additionally is within the scope of the present disclosure that outlet spout 132 may have any of a variety of shapes. As examples, outlet spout 132 also may have a shape that is at least partially, and optionally completely, polygonal, frusto-conical, cylindrical, generally cylindrical, circular, and/or elliptical, and/or may have any other suitable shape and/or cross-section, such as ergonomic shapes that facilitate comfortable engagement with a user's mouth for drinking potable drink liquid from drink container 10 directly through outlet spout 132. When present, outlet spout 132 may be formed of any of a variety of materials, examples of which include a rigid material, a semi-rigid material, a flexible material, a resiliently deformable material, a polymer, a plastic, silicone, and/or combinations thereof.

In some examples, cap assembly 100 may be configured such that the potable drink liquid may be freely dispensed from drink outlet 134 and/or outlet spout 132 when cover portion 130 is in the closed configuration. By this it is meant that outlet spout 132 may not include a valve that restricts or prevents flow of the drink liquid through outlet spout 132. However, in other embodiments, outlet spout 132 may include such a valve, such as a manual valve or a pressure-actuated valve that selectively restricts drink fluid from being dispensed through the drink outlet. Additionally or alternatively, cap assembly 100 may include and/or be configured to couple to a drink nozzle 112. In other words, drink nozzle 112 may be a component of cap assembly 100, or drink nozzle 112 may be an accessory that is utilized in conjunction with cap assembly 100. When drink nozzle 112 is included in and/or coupled to cap assembly 100, drink nozzle 112 is configured to channel liquid from and/or regulate the flow of liquid through drink outlet 134. Accordingly, drink nozzle 112 may be configured to fluidly couple to drink outlet 134, at least partially define drink outlet 134, and/or be sealingly attached to cover portion 130 about drink outlet 134.

Cap assembly 100 further may include a nozzle coupler 124 that is configured to selectively couple drink nozzle 112 to cover portion 130. More specifically, nozzle coupler 124 may be configured to sealingly couple drink nozzle 112 to cover portion 130 about (i.e., on or around) drink outlet 134 with drink nozzle 112 in fluid communication with drink outlet 134. In other words, nozzle coupler 124 may be configured to couple drink nozzle 112 to cover portion 130 such that liquid that exits drink outlet 134 flows into and/or through drink nozzle 112. Nozzle coupler 124 and drink nozzle 112 may be configured to operatively couple with one another in any suitable manner. Examples of suitable mechanisms by which nozzle coupler 124 and drink nozzle 112 may couple with one another include a friction-fit coupling, a threaded coupling, a twist-lock coupling, a bayonet lock coupling, a socket coupling, a quick disconnect coupling, an annular snap-fit coupling, and/or combinations thereof.

Nozzle coupler 124 and drink nozzle 112 may be configured to selectively and repeatedly couple to and decouple from one another without damage or destruction to cap assembly 100 and/or drink nozzle 112. Nozzle coupler 124 and drink nozzle 112 also may be configured to selectively couple with one another in a manner that retains drink nozzle 112 in fluid connection with drink outlet 134. Typically, one of nozzle coupler 124 and drink nozzle 112 includes a male portion of the coupling and the other of nozzle coupler 124 and drink nozzle 112 includes a corresponding female portion of the coupling. As discussed in more detail herein, in some examples, drink nozzle 112 and nozzle coupler 124 each include a male and female portion of the coupling.

Nozzle coupler 124 may be included in and/or disposed on or along cover portion 130 in any suitable manner. Typically, nozzle coupler 124 is included in and/or disposed along cover portion 130 about or surrounding drink outlet 134. More specifically, cover portion 130 may include an internal-facing surface 126 that faces internal compartment 26 in closed configuration 200, an external-facing surface 128 opposed to internal-facing surface 126, and an annular surface 138 that extends between internal-facing surface 126 and external-facing surface 128. Annular surface 138 also may extend circumferentially about or may include drink outlet 134. In other words, annular surface 138 may at least partially define drink outlet 134. Nozzle coupler 124 may be included in, disposed along, and/or defined along any one or more of internal-facing surface 126, external-facing surface 128, and annular surface 138. For examples in which nozzle coupler 124 is included, defined, or disposed along internal-facing surface 126 and/or external-facing surface 128, nozzle coupler 124 may be included, defined, or disposed along a region, for example an annular region, of internal-facing surface 126 and/or external-facing surface 128 that is proximate to, or immediately proximate to annular surface 138.

For examples in which cover portion 130 includes outlet spout 132, outlet spout 132 may be, be included in, and/or form at least a portion of nozzle coupler 124. Additionally or alternatively, nozzle coupler 124 may be disposed along outlet spout 132. More specifically, outlet spout 132 includes a spout interior surface 146 that may be continuous with or included in annular surface 138 and a spout exterior surface 148 that is opposed to spout interior surface 146. Spout exterior surface 148 may be continuous with or define a portion of external-facing surface 128. Accordingly, nozzle coupler 124 may be included in, disposed along, or form a portion of spout exterior surface 148 and/or spout interior surface 146.

In some examples, drink nozzle 112 includes a male portion 116 that extends within, and optionally engages, spout interior surface 146 and/or annular surface 138 when drink nozzle 112 is coupled to cover portion 130. Additionally or alternatively, male portion 116 of drink nozzle 112 may extend through spout interior surface 146 and/or annular surface 138 and engage internal-facing surface 126 of cover portion 130 when drink nozzle 112 is coupled to cover portion 130. Drink nozzle 112 additionally or alternatively may include a female portion 118 that engages spout exterior surface 148 when drink nozzle 112 is coupled to cover portion 130.

Nozzle coupler 124 and drink nozzle 112 also may include one or more sealing interfaces, or annular interfaces, that sealingly contact one another when nozzle coupler 124 and drink nozzle 112 are coupled to one another and that seal drink nozzle 112 about drink outlet 134. For example, one of drink nozzle 112 and nozzle coupler 124 may include a resilient sealing member (e.g., an O-ring) and the other of drink nozzle 112 and nozzle coupler 124 may include a sealing surface that the resilient sealing member seals against. As a more specific example, drink nozzle 112 may include a resilient annular sealing member that is secured to or forms a portion of male portion 116 and is configured to seal against annular surface 138 and/or spout interior surface 146 and/or a resilient sealing member that is secured to or forms a portion of female portion 118 and is configured to seal against spout exterior surface 148.

As a more specific example, drink nozzle 112 may be or include an outlet valve 140 that is configured to selectively restrict a flow of the potable drink liquid from drink outlet 134. Outlet valve 140 may include and/or be any of a variety of valves, examples of which include a bite-actuated valve, a self-sealing valve, a slit diaphragm valve, a manually-actuated valve, a push-pull valve, a rotary valve, a barrel valve, etc. When present, outlet valve 140 may be formed of any of a variety of materials, examples of which include a rigid material, a semi-rigid material, a flexible material, a resiliently deformable material, a polymer, a plastic, silicone, and/or combinations thereof.

In examples in which cover portion 130 includes outlet spout 132, outlet valve 140 may be configured to be operatively coupled to outlet spout 132 during operative use of cap assembly 100. In other words, outlet spout 132 may define nozzle coupler 124 for outlet valve 140. In particular, in some such examples, outlet valve 140 is configured to be selectively and repeatedly removed from and operatively coupled to outlet spout 132 without damage to cap assembly 100, such as to facilitate cleaning the outlet valve and/or the outlet spout and/or replacing the outlet valve. As discussed in more detail herein, outlet valve 140 may include male portion 116 and/or female portion 118.

In some examples, drink nozzle 112 includes a drink tube 60 that extends away from cap assembly 100 when drink tube 60 is operatively coupled to cover portion 130. Drink tube 60 may include a flexible, rigid, and/or semi-rigid liquid conduit through which the potable drink liquid may be dispensed to the user. Drink tube 60 may have a first end that is configured to be operatively coupled to cap assembly 100 at drink outlet 134, outlet spout 132, and/or via nozzle coupler 124. In particular, the first end of drink tube 60 may include male portion 116 and/or female portion 118, as discussed herein. Drink tube 60 also may include a second end that is distal to the first end and through which liquid is dispensed to the user. In some examples, the second end of drink tube 60 includes, or is configured to be coupled to, outlet valve 140. In some such examples, the second end of drink tube 60 includes a valve coupler 62 that is configured to selectively couple to outlet valve 140, for example, in a manner similar to that discussed herein for nozzle coupler 124. In some examples, valve coupler 62 is configured, dimensioned, and/or formed similarly to at least a portion of outlet spout 132, such that outlet valve 140 may be coupled to valve coupler 62 and to outlet spout 132 in a similar manner.

In some examples, cap assembly 100 is configured to interchangeably couple to a plurality of drink nozzles 112. In other words, cap assembly 100 may include a plurality of drink nozzles 112 and/or may be configured to be utilized in conjunction with a plurality of drink nozzles 112. As a more specific example, cap assembly 100 may include or be configured to be utilized in conjunction with drink tube 60 and outlet valve 140. In some such examples, during operative use of cap assembly 100, one of drink tube 60 and outlet valve 140 is directly coupled to nozzle coupler 124 and the other of drink tube 60 and outlet valve 140 is detached from nozzle coupler 124.

With continued reference to FIGS. 1-2, when cover portion 130 is in closed configuration 200 with cap assembly 100 operatively coupled to liquid vessel 20, cover portion 130 may operate to restrict the potable drink liquid from being introduced into or dispensed from the liquid vessel other than via drink outlet 134. Accordingly, in some examples, cap assembly 100 includes a sealing structure 150 that forms a liquid-tight seal between base portion 110 and cover portion 130 when cover portion 130 is in closed configuration 200. In this manner, sealing structure 150 operates to ensure that any potable drink liquid that passes through base portion 110 and/or base opening 120 is restricted and/or prevented from escaping cap assembly 100 other than via drink outlet 134.

When cover portion 130 is in the closed configuration, sealing structure 150 may operate to form a seal that is liquid-tight against an elevated hydrostatic pressure of the potable drink liquid, such as may be produced when liquid vessel 20 is intentionally or unintentionally squeezed and/or compressed. As more specific examples, sealing structure 150 may be configured such that, when cover portion 130 is in closed configuration 200, sealing structure 150 forms a seal that is liquid-tight against an internal fluid static pressure that is at least 5 pounds per square inch (psi) (34.5 kilopascals (kPa)), at least 10 psi (68.9 kPa), at least 15 psi (103.4 kPa), at most 20 psi (137.9 kPa), at most 12 psi (82.7 kPa), and/or at most 7 psi (48.3 kPa). In such examples, a threshold internal fluid static pressure at which sealing structure 150 ceases to form a liquid-tight seal may be referred to as a cracking pressure of sealing structure 150. In examples in which cap assembly 100 includes outlet valve 140, the cracking pressure of sealing structure 150 may be greater than a cracking pressure of outlet valve 140. In particular, such a configuration may ensure that any increase in the internal pressure of the potable drink liquid that is sufficient to overcome a liquid-tight seal formed by cap assembly 100 causes the potable drink liquid to escape the cap assembly preferentially via outlet valve 140 rather than via a region between base portion 110 and cover portion 130.

Sealing structure 150 may include any of a variety of components and/or features for forming a liquid-tight seal when cover portion 130 is in the closed configuration. In some examples, base portion 110 includes a base portion sealing surface 152, and cover portion 130 includes a cover portion sealing surface 160 such that sealing structure 150 includes base portion sealing surface 152 and cover portion sealing surface 160. In such examples, when cover portion 130 is in closed configuration 200, base portion sealing surface 152 seals against cover portion sealing surface 160 to form the liquid-tight seal.

When present, base portion sealing surface 152 and cover portion sealing surface 160 each may have any suitable respective component(s) and/or form(s) for forming the liquid-tight seal. For example, as perhaps best seen in FIG. 2, base portion 110 may include a sealing lip 154 that includes or defines at least some of base portion sealing surface 152. Sealing lip 154 may extend circumferentially about base opening 120 and extend towards cover portion 130, at least when cover portion 130 is in the closed configuration. Stated differently, sealing lip 154 may be an annular ridge and/or protrusion that surrounds base opening 120 and that extends toward and engages cover portion sealing surface 160 at least when cover portion 130 is in the closed configuration. In such examples, sealing lip 154 may correspond to a portion and/or a region of base portion 110 that is integrally formed with and/or monolithic with at least a portion of a remainder of base portion 110. In such examples, base portion 110 may be described as defining sealing lip 154. In other examples, sealing lip 154 may include and/or be a component that is formed separately from, and/or operatively coupled to, at least a portion of the remainder of the base portion.

Additionally or alternatively, cover portion 130 may include sealing lip 154 that protrudes from internal-facing surface 126 towards base portion 110, at least when cover portion 130 is in closed configuration 200. In such examples, sealing lip 154 of cover portion 130 includes or defines at least some of cover portion sealing surface 160. Sealing lip 154 of cover portion 130 may extend circumferentially about base opening 120 when cover portion 130 is in closed configuration 200. In other words, sealing lip 154 may be positioned over and have a wider diameter than base opening 120.

Base portion 120 and/or cover portion 130 may comprise a respective sealing gasket 162 that is configured to resiliently deform when cover portion 130 is pivoted towards closed configuration 200 and brought into contact with base portion 110. Sealing gasket 162 may include and/or be any suitable form of resilient sealing component, for example, a rubber sealing component, a silicone sealing component, an O-ring, a sealing gasket that is at least partially flat, a sealing component that extends toward base portion 110 when sealing gasket 162 forms a portion of or is secured to cover portion 130, and/or a sealing component that extends toward cover portion 130 when sealing gasket 162 forms a portion of or is secured to base portion 110.

For examples in which base portion 110 includes sealing gasket 162, sealing gasket 162 includes and/or defines at least some of base portion sealing surface 152. Likewise, for examples in which cover portion 130 includes sealing gasket 162, sealing gasket 162 includes or defines at least some of cover portion sealing surface 160. In either case, sealing gasket 162 may extend circumferentially about base opening 120 when cover portion 130 is in closed configuration 200, such as to form a liquid-tight seal across a full circumferential extent of base portion sealing surface 152 and cover portion sealing surface 160.

For examples in which base portion 110 and cover portion 130 each include a respective sealing gasket 162, sealing gaskets 162 may be configured to seal against one another when cover portion 130 is in closed configuration 200. For examples in which one of base portion 110 and cover portion 130 includes sealing lip 154 and the other of base portion 110 and cover portion 130 includes sealing gasket 162, sealing gasket 162 may be positioned to engage, resiliently deform, and seal against sealing lip 154 when cover portion 130 is in closed configuration 200.

Cover portion 130 and/or base portion 110 may be configured to engage and/or support the respective sealing gasket 162 in any suitable manner. For example, when cover portion 130 and/or base portion 110 includes sealing gasket 162, cover portion 130 and/or base portion 110 further may include a sealing gasket receiver 144 that receives at least a portion of sealing gasket 162 during operative use of cap assembly 100. Sealing gasket receiver 144 may be or include any suitable structure for receiving and/or engaging sealing gasket 162, examples of which include a groove, a channel, and/or a recess formed in and/or defined by cover portion 130 or base portion 110. In some such examples, sealing gasket 162 is frictionally received within sealing gasket receiver 144 during operative use of cap assembly 100. Additionally or alternatively, sealing gasket 162 may be supported and/or maintained within sealing gasket receiver 144 at least partially via a mechanical coupling (e.g., by stretching sealing gasket 162 over a catch structure formed by sealing gasket receiver 144) and/or via an adhesive coupling.

In some examples, sealing gasket 162 is configured to be selectively and repeatedly removed from and replaced into sealing gasket receiver 144 without damage to the cover portion sealing surface. In this manner, sealing structure 150 may be configured such that sealing gasket 162 may be selectively removed from sealing gasket receiver 144, such as to facilitate cleaning and/or replacement of sealing gasket 162.

With continued reference to FIGS. 1-2, hinge 180 may include any of a variety of components and/or features for facilitating and/or enabling cover portion 130 to transition between the closed configuration and the open configuration. In some examples, hinge 180 constrains cover portion 130 to travel along a predefined cover path as the cover portion transitions between the closed configuration and the open configuration. Additionally or alternatively, hinge 180 may constrain cover portion 130 to travel along a cover path that extends within a predefined cover path plane as cover portion 130 transitions between closed configuration 200 and open configuration 202. Hinge 180 constraining the cover path of cover portion 130 in this manner may enable cover portion 130 to move along the cover path even responsive to indirect forces or forces that are not directly along the cover path. Accordingly, cover portion 130 may be transitioned from open configuration 202 to closed configuration 200 without a user needing to guide cover portion 130, which may allow for one-handed operation of cap assembly 110. Such configurations may be described as contrasting with a configuration in which cover portion 130 is operatively coupled to base portion 110 via a flexible tether that does not constrain the cover portion to travel along a predefined cover path and/or within a predefined cover path plane.

Hinge 180 may be configured such that pivot axis 182 has any suitable orientation relative to base portion 110 and/or cover portion 130. In some examples, pivot axis 182 extends at least substantially parallel to a plane defined by base opening 120. Additionally or alternatively, pivot axis 182 may extend at least partially through base portion 110 and cover portion 130. Hinge 180 may include a hinge pin 184 that extends along and/or defines pivot axis 182. In some such examples, hinge pin 184 extends at least partially through each of base portion 110 and cover portion 130. Accordingly, in such examples, hinge pin 184 may be described as at least partially operatively coupling cover portion 130 to base portion 110.

In some examples, hinge 180 may be configured to at least partially restrict pivotal motion of cover portion 130 relative to base portion 110. For example, hinge 180 and/or hinge pin 184 may be configured to produce a frictional force that at least partially restricts cover portion 130 from pivoting relative to base portion 110 other than as a result of an intentional action by the user. Stated differently, when cover portion 130 is in open configuration 202, hinge 180 may be configured to at least partially restrict the cover portion from pivoting relative to base portion 110 and/or to at least partially retain the cover portion in open configuration 202. In this manner, hinge 180 also may function to maintain cover portion 130 in open configuration 202 and/or at a given (i.e., a particular) angular orientation relative to base portion 110, such as to restrict cover portion 130 from inadvertently transitioning toward the closed configuration while liquid vessel 20 is being filled via base opening 120.

Hinge 180 also may be configured to restrict cover portion 130 from pivoting beyond a threshold open angle with respect to base portion 110 when cover portion 130 is in open configuration 202. More specifically, cover portion 130 may pivot in a first direction 204 from closed configuration 200 to open configuration 202 and in a second direction 206 from open configuration 202 to closed configuration 200. Hinge 180 may be configured to restrict cover portion 130 from pivoting in first direction 204 beyond the threshold open angle, which may be measured between a plane defined by base opening 120 and a plane defined by drink outlet 134. As examples, the threshold open angle may be at least 90°, at least 120°, at least 130°, at least 140°, at least 150°, at least 160°, at least 170°, at least 180°, at least 200°, at least 220°, at most 120°, at most 130°, at most 140°, at most 150°, at most 160°, at most 170°, at most 180°, at most 200°, at most 220°, and/or at most 270°.

In some examples, hinge 180 is configured such that pivot axis 182 remains nominally fully stationary relative to base portion 110 and/or cover portion 130 as the cover portion transitions between the closed configuration and the open configuration. In particular, this may be the case in examples in which hinge pin 184 extends at least partially through each of base portion 110 and cover portion 130. However, this is not required of all examples of hinge 180, and it additionally is within the scope of the present disclosure that pivot axis 182 may shift relative to base portion 110 and/or cover portion 130 as the cover portion transitions between the closed configuration and the open configuration. Additionally or alternatively, in some examples, hinge 180 may include and/or be a living hinge, and/or may be configured such that at least a portion of the hinge is integrally formed with base portion 110 and/or with cover portion 130. Hinge 180 also may include a plurality of hinge pins 184 about which cover portion 130 pivots relative to base portion 110. Hinge 180 additionally or alternatively may be referred to as a hinge assembly 180 and/or a hinge mechanism 180 and, as discussed, may include one or more component parts.

As further shown in FIGS. 1-2, cap assembly 100 may include various components and/or features for selectively maintaining cover portion 130 in closed configuration 200 and/or for selectively restricting cover portion 130 from being transitioned to open configuration 202. In particular, cap assembly 100 may include a closure mechanism 190 configured to selectively maintain cover portion 130 in closed configuration 200. Closure mechanism 190 may be configured to operate in any of a variety of manners. For example, closure mechanism 190 may be configured to transition between an engaged configuration, in which the closure mechanism maintains cover portion 130 in closed configuration 200, and a disengaged configuration, in which cover portion 130 is free to transition from closed configuration 200 to open configuration 202.

Closure mechanism 190 may be biased toward the engaged configuration at least when cover portion 130 is in closed configuration 200. Stated differently, closure mechanism 190 may be configured such that closure mechanism 190 automatically transitions toward and/or to the engaged configuration when cover portion 130 is in closed configuration 200. In some examples, closure mechanism 190 additionally may be configured to transition to the engaged configuration automatically when cover portion 130 transitions from the open configuration to the closed configuration.

Closure mechanism 190 may include any of a variety of structures for selectively maintaining cover portion 130 in the closed configuration 200. Generally speaking, closure mechanism 190 may include a cover portion interlock 191 that is mechanically confined to cover portion 130 and a base portion interlock 189 that is mechanically confined to base portion 110. As utilized in this context, the cover portion interlock 191 being "structurally confined" to cover portion 130 means that cover portion interlock 191 is formed in cover portion 130, is affixed to cover portion 130, is defined by cover portion 130, and/or remains attached to cover portion 130 when cover portion 130 is in both open configuration 202 and closed configuration 200. Similarly, base portion interlock 189 may be formed in base portion 110, affixed to base portion 110, defined by base portion 110, and/or remain attached to base portion 110 when cover portion 130 is in open configuration 202 and closed configuration 200.

When included, cover portion interlock 191 and base portion interlock 189 are configured to interlock with one another when closure mechanism 190 is in the engaged configuration and to maintain cover portion 130 in closed configuration 200. Cover portion interlock 191 and base portion interlock 189 also are configured to be selectively disengaged from one another to transition closure mechanism 190 from the engaged configuration to the disengaged configuration and to permit cover portion 130 to be transitioned from closed configuration 200 to open configuration 202.

Cover portion interlock 191 and base portion interlock 189 may be disposed along any suitable region of cap assembly 100 such that cover portion interlock 191 and base portion interlock 189 are positioned to interlock with one another when cover portion 130 is in, or transitioned into, closed configuration 200. In some examples, cover portion interlock 191 and base portion interlock 189 are disposed along a region of cap assembly 100 that is at least substantially distal to, or opposed to, hinge 180. Additionally or alternatively, cover portion interlock 191 and base portion interlock 189 may extend circumferentially about at least a portion of base opening 120.

As a more specific example, one of cover portion interlock 191 and base portion interlock 189 may define a catch, and the other of cover portion interlock 191 and base portion interlock 189 may define a receiver for selectively receiving the catch. More specific examples of suitable catches include a ledge, a hooked lip, a rib, a bead, a ridge, a plug, a protrusion, a plunger, a spring plunger, a ball plunger, and/or a magnet, and the receiver may include any suitable corresponding structure for receiving the catch.

As a more specific example, and as best seen in FIG. 2, one of cover portion interlock 191 and base portion interlock 189 may include a latch catch 194, and the other of cover portion interlock 191 and base portion interlock 189 may include a catch receiver 192 that is configured to engage latch catch 194 when cover portion 130 is in closed configuration 200 and closure mechanism 190 is in the engaged configuration.

Closure mechanism 190 also may include any of a variety of structures and/or features to facilitate selectively transitioning closure mechanism 190 between the engaged configuration and the disengaged configuration. For example, closure mechanism 190 may include a closure actuator 195 that is configured to, or utilized to, selectively disengage cover portion interlock 191 and base portion interlock 189 from one another. In some examples, closure actuator 195 interconnects one of base portion interlock 189 and cover portion interlock 191 to the corresponding portion of cap assembly 100. In such examples, closure actuator 195 may be fixedly coupled to and/or integrally formed with the one of base portion interlock 189 and cover portion interlock 191 and the corresponding portion of cap assembly 100.

As yet another more specific example, closure actuator 195 may include a release lever 170 that is integral with, fixedly coupled to, and/or that defines latch catch 194. Release lever 170 may be configured to be selectively moved away from catch receiver 192 to disengage latch catch 194 from catch receiver 192, thus transitioning closure mechanism 190 from the engaged configuration to the disengaged configuration. Release lever 170 also may be biased (e.g., resiliently biased or spring biased) to move latch catch 194 into engagement with catch receiver 192 when cover portion 130 is transitioned into closed configuration 200. Release lever 170 may be attached to the corresponding portion of cap assembly 100 in any suitable manner. For example, release lever 170 may be integrally formed with, mechanically coupled to, and/or hingedly coupled to the corresponding portion of cap assembly 100. As shown in FIGS. 1 and 2, release lever 170 may be integrally formed with or affixed to cover portion 130 or base portion 110.

Cap assembly 100 further may include a biasing mechanism 198 that urges cover portion 130 to pivot away from base portion 110 when cover portion 130 is in closed configuration 200. In some examples, biasing mechanism 198 increases a contact force between latch catch 194 and catch receiver 192, which may operate to increase the force required to transition closure mechanism 190 from the engaged configuration to the disengaged configuration. For example, hinge 180 may include the biasing mechanism, for example a spring biasing mechanism, that urges cover portion 130 to pivot in first direction 204 away from base portion 110 when cover portion 130 is in closed configuration 200. Additionally or alternatively, sealing gasket 162 may operate as biasing mechanism 198 by resiliently urging cover portion 130 to pivot in first direction 204 when cover portion 130 is transitioned to open configuration 202.

Closure mechanism 190 may include a lock mechanism 196 configured to selectively retain the closure mechanism in the engaged configuration. Lock mechanism 196 thus may operate to restrict and/or prevent cover portion 130 from inadvertently transitioning from closed configuration 200 to open configuration 202, such as to reduce a likelihood of spillage of the potable drink liquid from drink container 10. When present, lock mechanism 196 may include and/or be any of a variety of structures and/or mechanisms, examples of which include a twist-lock mechanism, a slide-lock mechanism, a cam-lock mechanism, an over-center cam lock mechanism, etc.

With continued reference to FIGS. 1-2, cap assembly 100 may be configured to be operatively coupled to liquid vessel 20 in any of a variety of manners. For example, base portion 110 may include at least a portion of a cap coupling mechanism 114 that is configured to selectively couple cap assembly 100 to liquid vessel 20. In some such examples, cap coupling mechanism 114 may be configured to selectively couple cap assembly 100 to liquid vessel 20 at least partially via a threaded coupling. Stated differently, cap coupling mechanism 114 may include threads formed on base portion 110 and on neck 22 of liquid vessel 20 that matingly engage one another to operatively couple cap assembly 100 to the liquid vessel. In this manner, neck 22 additionally or alternatively may be described as including at least a portion of cap coupling mechanism 114. However, this is not required, and it additionally is within the scope of the present disclosure that cap coupling mechanism 114 may include and/or be any additional or alternative mechanism. For example, cap coupling mechanism 114 additionally or alternatively may be configured to selectively couple cap assembly 100 to liquid vessel 20 at least partially via a friction-fit coupling, via a bayonet lock mechanism, etc.

While the present disclosure generally relates to examples in which cap assembly 100 and liquid vessel 20 are separate components that are configured to be selectively and operatively coupled to one another, such as via cap coupling mechanism 114, this is not required of all examples of drink container 10. For example, it also is within the scope of the present disclosure that cap assembly 100 may be operatively coupled to liquid vessel 20 in such a manner that at least a portion of the cap assembly is not configured to be removed from the liquid vessel without damage to the cap assembly and/or to the liquid vessel. In such examples, cap assembly 100 and/or cover portion 130 may be described as being non-removably coupled to liquid vessel 20, as being directly coupled to liquid vessel 20, and/or as being fixedly coupled to liquid vessel 20. In such examples, cap assembly 100 and/or cover portion 130 may be operatively coupled to any suitable portion of liquid vessel 20, such as to neck 22 and/or to an upper portion or wall of the liquid vessel that is proximate to neck opening 24 of the liquid vessel.

In some examples in which cap assembly 100 is fixedly coupled to liquid vessel 20, cover portion 130 may be hingedly and/or pivotally coupled to liquid vessel 20 and/or to neck 22 thereof. In such examples, liquid vessel 20 and/or neck 22 may define and/or form at least a portion of hinge 180. Additionally or alternatively, in such examples, sealing structure 150 may be configured to form a liquid-tight seal between cover portion 130 and a portion of liquid vessel 20, such as neck 22, and/or another sealing structure of the liquid vessel, such as a lip, a rim, an edge, etc. For example, liquid vessel 20 may include and/or define a portion of sealing structure 150, such as base portion sealing surface 152 as disclosed herein.

In some examples in which cap assembly 100 and/or cover portion 130 is fixedly and/or non-removably coupled to liquid vessel 20, the liquid vessel may be described as including and/or defining at least a portion of base portion 110, such that descriptions herein of structures and/or features of the base portion may be understood as describing corresponding structures and/or features of the liquid vessel. Alternatively, in some examples in which cap assembly 100 and/or cover portion 130 is fixedly coupled to liquid vessel 20, the cap assembly may be described as including cover portion 130 but not base portion 110.

As discussed, liquid vessel 20 is adapted to receive and hold or otherwise contain up to a predetermined volume of potable drink liquid for selective consumption by a user, such as when the liquid is dispensed through drink outlet 134 of cap assembly 100. The potable drink liquid may be selectively dispensed from internal compartment 26 to the user from neck 22 when cap assembly 100 is not secured to the neck and/or when the cap assembly is operatively coupled to the neck. It is within the scope of the present disclosure that neck 22 may (but is not required in all embodiments to) define the only opening of liquid vessel 20 through which potable drink liquid may be added to or removed from the liquid vessel. As discussed herein, when cap assembly 100 is operatively coupled to liquid vessel 20 and when cover portion 130 is in the closed configuration, this selective dispensing of the drink liquid may be only through drink outlet 134 of the cap assembly when cover portion 130 is in the closed configuration.

Liquid vessel 20 may have any suitable shape and may be formed from any suitable material or combination of materials to hold up to a predetermined volume of drink liquid. Examples of suitable internal volumes, sizes, or capacities, of liquid vessel 20 and/or of internal compartment 26 (i.e., volumes of potable drink liquid able to be received into a liquid vessel at one time) include at least 125 milliliters (mL), at least 150 mL, at least 200 mL, at least 300 mL, at least 400 mL, at least 500 mL, at least 750 mL, at least 1 liter (L), at least 1.5 L, at most 2 L, at most 1.2 L, at most 800 mL, at most 600 mL, at most 450 mL, at most 350 mL, at most 250 mL, at most 175 mL, and/or at most 140 mL (with these examples referring to volumes of potable drink liquid that may be received at one time into an empty liquid container). It is within the scope of the present disclosure that liquid vessels having different sizes, including sizes that are smaller than, larger than, or within the illustrative sizes and/or ranges presented above, may be used without departing from the scope of the present disclosure.

Liquid vessel 20 may be rigid, semi-rigid, or non-rigid. For examples in which liquid vessel 20 is rigid or semi rigid, liquid vessel 20 may include a bottom surface such that the liquid vessel may be generally self-supporting, or free-standing, when the bottom surface is placed on a horizontal surface. In such embodiments, drink container 10 may be referred to as a drink bottle. For examples in which liquid vessel 20 is rigid and cap assembly 100 includes, or is configured to couple to drink tube 60, drink tube 60 may be configured to extend into and through at least a substantial portion of internal compartment 26 such that drink tube 60 may draw liquid from near the bottom of internal compartment 26. Additionally or alternatively, for examples in which liquid vessel 20 is rigid and cap assembly 100 includes, or is configured to couple to drink tube 60 or outlet valve 140, cap assembly 100 further may include a vent that may permit air to enter internal compartment 26 as fluid is drawn therefrom via drink outlet 134. Examples of suitable materials for constructing a rigid liquid vessel include polycarbonate, glass, plastic, and/or metal, such as aluminum or stainless steel. As discussed herein, liquid vessel 20 also optionally may have a double-wall or other insulated construction.

As mentioned, liquid vessel 20 may have a non-rigid and/or fully collapsible structure. In such an embodiment, liquid vessel 20 may not be configured to return automatically to its prior configuration upon reduction of the force and/or pressure that was applied to urge the sides of liquid vessel 20 toward each other, such as to dispense liquid from drink container 10 through cap assembly 100. For example, in such an embodiment, liquid vessel 20 may be configured to assume and maintain a configuration that is at least substantially flattened, collapsed, and/or deflated after the volume of liquid vessel 20 is reduced, such as by squeezing liquid vessel 20 and dispensing liquid from liquid vessel 20 through the cap assembly 100. Such embodiments may be described as flasks, soft flasks, flexible flasks, collapsible flasks, flexible water bottles, and/or collapsible water bottles. Examples of suitable materials for forming fully collapsible or non-rigid liquid vessels 20 include high-density polyethylene (HDPE), low-density polyethylene (LDPE), copolyester, polypropylene, polyurethane, thermoplastic polyurethane, and/or silicone.

As mentioned, liquid vessel 20 also may have a semi-rigid construction in which the liquid vessel may be reversibly (and nondestructively) collapsed during use. Such an example may permit opposing portions of liquid vessel 20 to be squeezed and/or otherwise urged from a nominal, or un-collapsed configuration, toward, or even into contact with, each other to reduce the volume of liquid vessel 20 and thereby aid in the dispensing of potable drink liquid therefrom. In such an embodiment, liquid vessel 20 may be configured to return automatically to its prior (nominal) configuration upon reduction of the force and/or pressure that was applied to urge the sides of the liquid vessel toward each other. Such embodiments may be described as squeeze bottles, as having a squeezable liquid vessel, and/or as having a resiliently deformable liquid vessel. Examples of suitable materials for forming semi-rigid liquid vessels 20 include high-density polyethylene (HDPE), low-density polyethylene (LDPE), copolyester, polypropylene, polyurethane, thermoplastic polyurethane, and/or silicone.

In some examples, liquid vessel 20 includes an inner vessel surface 28 that at least partially defines internal compartment 26 and an outer vessel surface 30 that is configured to be gripped by the user. In some such examples, inner vessel surface 28 and outer vessel surface 30 may refer to opposed surfaces of a single wall or single-layer structure that at least partially defines internal compartment 26. Alternatively, inner vessel surface 28 and outer vessel surface 30 may correspond to separate structures, or walls, for example, such that the outer vessel surface is at least partially spaced apart from the inner vessel surface. In such examples, liquid vessel 20 also may be referred to as a double-wall liquid vessel 20.

In some examples, such as when liquid vessel 20 includes inner vessel surface 28 and outer vessel surface 30 that are spaced apart from one another, liquid vessel 20 may have an insulated construction. In particular, liquid vessel 20 may include an insulation layer 40 that is configured to restrict a transfer of heat energy through the liquid vessel, such as to maintain the potable drink liquid at a temperature that is lower or higher than an ambient temperature and/or a temperature of the user's hand. In some examples, insulation layer 40 may be positioned between inner vessel surface 28 and outer vessel surface 30. Insulation layer 40 may be formed of any of a variety of materials, such as a foam, an open-cell foam, and/or a metallic foil. As additional examples, insulation layer 40 may include and/or be a fluid, such as a liquid, a gas, air, and/or a fluid with a low thermal conductivity. Alternatively, in some embodiments, liquid vessel 20 may be an insulated vessel with inner vessel surface 28 and outer vessel surface 30 spaced apart from one another but without a distinct insulation layer 40 positioned between the inner vessel surface and the outer vessel surface. In such an embodiment, a space between inner vessel surface 28 and outer vessel surface 30 may be at least partially evacuated, such as to restrict transfer of heat energy between the inner vessel surface and the outer vessel surface.

When present, insulation layer 40 may be formed and/or positioned within liquid vessel 20 in any of a variety of manners. As examples, insulation layer 40 may be formed on inner vessel surface 28 and/or on outer vessel surface 30, or may be adhered to the inner vessel surface and/or to the outer vessel surface. Insulation layer 40 may be at least substantially opaque. Additionally or alternatively, insulation layer 40 may be at least partially optically transparent and/or optically translucent.

In some examples, outer vessel surface 30 includes a grip feature 32 that is configured to facilitate gripping of drink container 10 by a user's hand. In such examples, grip feature 32 may include and/or be any of a variety of structures and/or features, such as a region of outer vessel surface 30 that is textured. When present, grip feature 32 may be formed of the same material that forms outer vessel surface 30, such as a region of the outer vessel surface that is textured and/or otherwise configured to facilitate gripping of drink container 10 by the user's hand. In other examples, grip feature 32 may be formed of a material that is different than that of outer vessel surface 30, and/or a material that is operatively coupled and/or affixed to the outer vessel surface. For example, grip feature 32 may include and/or be a material that is selected to yield an increased coefficient of friction between the user's hand and the grip feature relative to a coefficient of friction between the user's hand and a portion of outer vessel surface 30 apart from the grip feature.

Additionally or alternatively, in some examples, drink container 10 includes one or more features for retaining the drink container in the user's hand even while the user does not actively grip the drink container. In particular, drink container 10 may include a hand strap 70 that is configured to extend across at least a portion of the user's hand to at least partially retain the drink container against the user's hand during operative use of the drink container. In such examples, hand strap 70 may be elastic and/or selectively adjustable in length, such as to fit and/or tighten the hand strap upon the user's hand.

Figure 3:
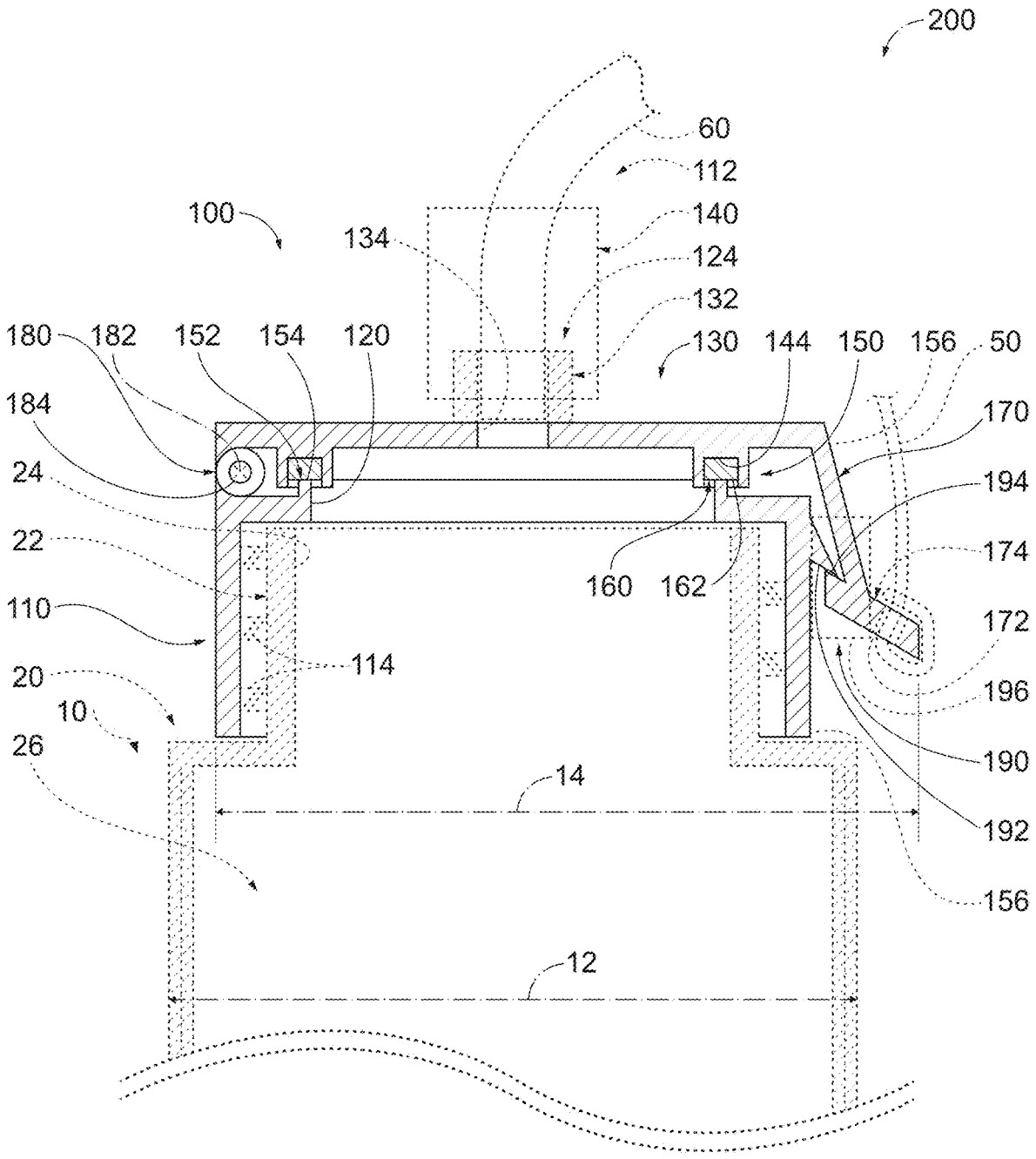
FIG. 3 is a fragmentary cross-sectional side elevation view representing somewhat less schematic examples of drink containers including cap assemblies with a cover portion in the closed configuration according to the present disclosure.
Figure 4:
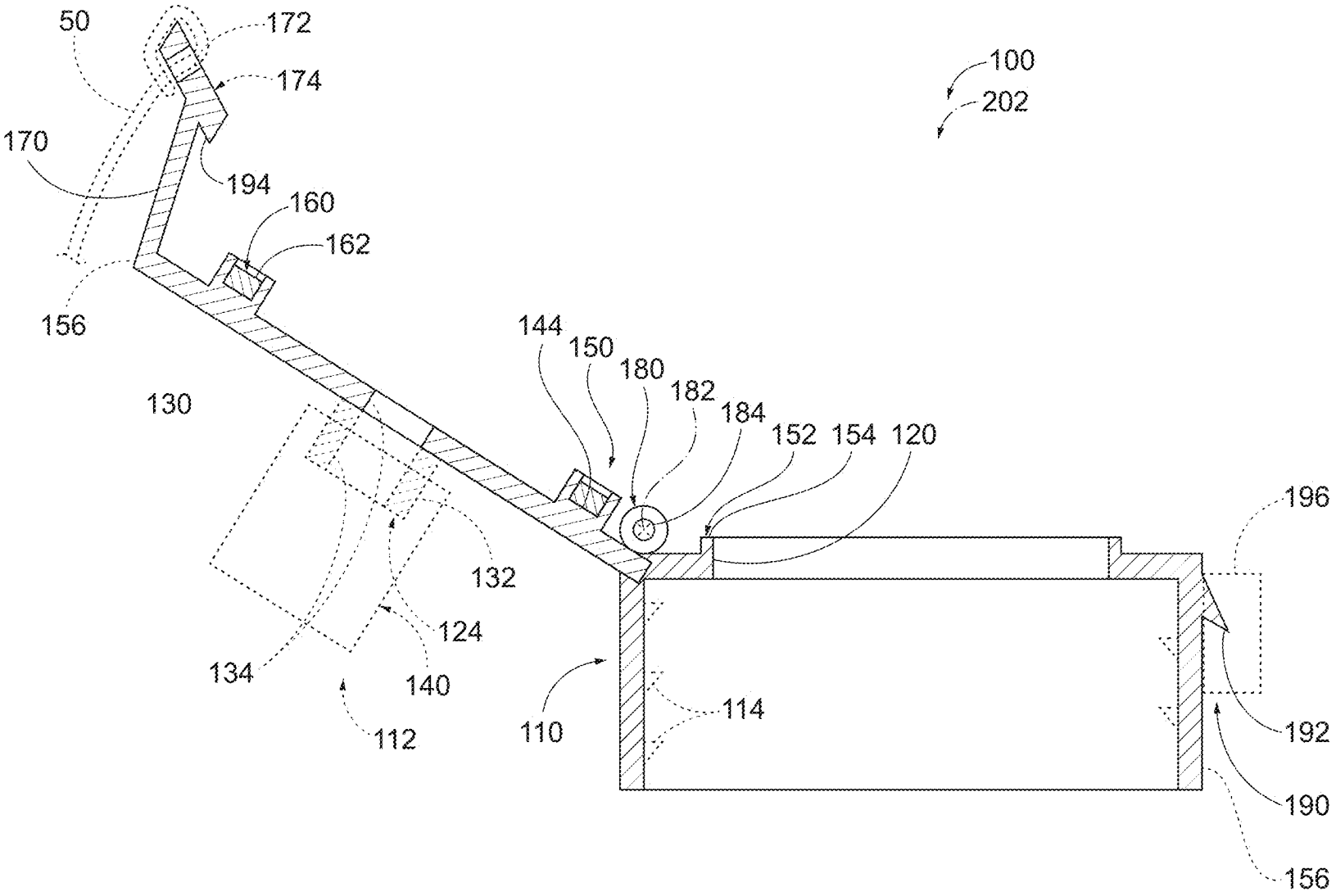
FIG. 4 is a schematic cross-sectional side view representing the examples of FIG. 3 with the cover portion in an open configuration.

FIGS. 3-4 are cross-sectional side elevation views illustrating somewhat less schematic examples of cap assemblies 100 and drink containers 10 comprising cap assemblies 100 according to the present disclosure. More specifically, FIG. 3 illustrates cap assembly 100 operatively coupled to liquid vessel 20 with cover portion 130 in closed configuration 200, and FIG. 4 illustrates cap assembly 100 detached from liquid vessel 20 with cover portion 130 in open configuration 202.

With reference to FIGS. 3-4, and as discussed herein, cap assembly 100 comprises base portion 110, cover portion 130, and hinge 180 that couples cover portion 130 to base portion 110 and permits cover portion 130 to pivot relative to base portion 110 between open configuration 202 and closed configuration 200. Base portion 110 is configured to be secured to neck 22 of liquid vessel 20 and includes base opening 120 that may be centered about neck 22. Specifically, base portion 110 may include a portion of cap coupling mechanism 114 that selectively secures base portion 110 to neck 22.

Cover portion 130 includes drink outlet 134, and cover portion 130 further may include outlet spout 132 that is centered about and at least partially defines drink outlet 134. Additionally or alternatively, cover portion 130 may include nozzle coupler 124 that is configured to couple drink nozzle 112 to cover portion 130, as discussed herein. Cap assembly 100 further may include and/or be configured to be utilized in conjunction with drink nozzle 112 (e.g., drink tube 60 and/or outlet valve 140). Drink nozzle 112 may be affixed to cover portion 130, or drink nozzle 112 may be configured to selectively couple to cover portion 130 via nozzle coupler 124, as discussed herein.

In the examples of FIGS. 3-4, cap assembly 100 further includes sealing structure 150 that is configured to form a liquid-tight seal between cover portion 130 and base portion 110 when cover portion 130 is in closed configuration 200. More specifically, in the examples of FIGS. 3-4, sealing structure 150 comprises sealing gasket 162 that includes and/or forms cover portion sealing surface 160, and cover portion 130 includes sealing gasket receiver 144 that receives and supports sealing gasket 162. In other words, sealing gasket receiver 144 operably affixes (i.e., releasably or fixedly, as discussed herein) sealing gasket 162 to cover portion 130. Sealing structure 150 further includes sealing lip 154 that incudes and/or forms base portion sealing surface 152. Sealing lip 154 is affixed to and/or integrally formed with base portion 110, and sealing lip 154 extends circumferentially about base opening 120. Sealing gasket 162 and sealing lip 154 are positioned, shaped, and dimensioned to engage one another when cover portion 130 is in closed configuration 200 to form a liquid-tight seal about the full circumference of base opening 120.

With continued reference to the examples of FIGS. 3-4, hinge 180 defines pivot axis 182 about which hinge 180 permits cover portion 130 to pivot relative to base portion 110. More specifically, hinge 180 may include a hinge pin 184 that extends through at least a portion of base portion 110 and cover portion 130 and that defines pivot axis 182. In other words, hinge pin 184 may pivotally connect base portion 110 to cover portion 130.

In these examples, cap assembly 100 further includes closure mechanism 190 that is configured to selectively maintain cover portion 130 in closed configuration 200, as discussed herein. More specifically, in these examples, closure mechanism 190 includes latch catch 194, catch receiver 192, and release lever 170. Release lever 170 is operatively affixed to cover portion 130. Latch catch 194 is affixed to and/or integral with release lever 170, such that release lever 170 interconnects latch catch 194 to cover portion 130. More specifically, latch catch 194 protrudes from release lever 170 towards base portion 110, at least when cover portion 130 is in closed configuration 200. Catch receiver 192 is affixed to and/or integral with base portion 110 and protrudes from base portion 110 towards release lever 170, at least when cover portion 130 is in closed configuration 200. Catch receiver 192 is positioned along base portion 110 to engage and interlock with latch catch 194 when cover portion 130 is in closed configuration 200 and closure mechanism 190 is in the engaged configuration.

Release lever 170 may be configured such that, when cover portion 130 is in closed configuration 200, release lever 170 is biased toward catch receiver 192 to bias closure mechanism 190 toward the engaged configuration. As a more specific example, release lever 170 may be integrally formed with at least a portion of cover portion 130 such that release lever 170 is biased toward a nominal configuration in which latch catch 194 is positioned to interlock with catch receiver 192. That is, the nominal configuration of release lever 170 may correspond to the engaged configuration of closure mechanism 190 when cover portion 130 is in closed configuration 200. In such examples, release lever 170 may be selectively urged radially outward (e.g., away from catch receiver 192 when cover portion 130 is in closed configuration 200) owing to an inherent resiliency of the material of which cover portion 130 and release lever 170 are formed.

Closure mechanism 190 may be disposed along a circumferentially peripheral region of cap assembly 100. More specifically, closure mechanism 190 may extend from and/or be affixed along exterior sidewalls 156 of base portion 110 and cover portion 130. Release lever 170 may be shaped, sized, oriented, and/or otherwise configured to extend substantially adjacent to a remainder of cap assembly 100, such as to base portion 110, at least when cover portion 130 is in closed configuration 200. In this manner, incorporation of release lever 170 into cap assembly 100 may result in cap assembly 100 remaining sufficiently low-profile that release lever 170 is unlikely to catch upon external objects, such as an edge of a pocket in which drink container 10 is inserted, during operative use of the drink container.

As a more specific example, drink container 10 and/or cap assembly 100 may be utilized during the performance of outdoor sports, such as running, in which it may be desirable to stow the liquid container in a pocket, holster, sleeve, etc. that is worn and/or carried by the user while the user is not drinking from the drink container. Accordingly, configuring release lever 170 to extend proximate to base portion 110 and/or to liquid vessel 20 during operative use of cap assembly 100 may minimize a likelihood of the release lever inadvertently being actuated to transition closure mechanism 190 to the disengaged configuration and/or to transition cover portion 130 to the open configuration.

More specifically, as perhaps best seen in FIG. 3, liquid vessel 20 may be characterized in terms of a liquid vessel maximum diameter 12 thereof, and cap assembly 100 may be characterized in terms of a cap assembly maximum diameter 14 thereof such that the cap assembly maximum diameter is similar to (e.g., approximately equal to) the liquid vessel maximum diameter. As more specific examples, drink container 10 may be configured such that cap assembly maximum diameter 14 is at most 125% of liquid vessel maximum diameter 12, at most 120% of the liquid vessel maximum diameter, at most 110% of the liquid vessel maximum diameter, at most 100% of the liquid vessel maximum diameter, at most 90% of the liquid vessel maximum diameter, at most 80% of the liquid vessel maximum diameter, and/or at least 70% of the liquid vessel maximum diameter.

Release lever 170 may include any suitable structure for actuating release lever 170, or moving latch catch 194, relative to catch receiver 192. For example, release lever 170 may include a lever flange 174 that extends radially outward from release lever 170 (i.e., outward with respect to exterior sidewall 156) and optionally beneath (i.e., along a direction towards liquid vessel 20 in closed configuration 200) latch catch 194. Lever flange 174 may be engaged by a user, such as using their thumb, to move latch catch 194 away from catch receiver 192.

Additionally or alternatively, release lever 170 may define or include a pull receiver 172 for selectively coupling a pull accessory 50 to release lever 170. In some examples, pull receiver 172 is disposed along lever flange 174. Coupling pull accessory 50 to cap assembly 100 may facilitate transitioning closure mechanism 190 from the engaged configuration to the disengaged configuration, such as by enabling the user to grip the relatively large and/or long pull accessory in order to pull release lever 170 radially outward and/or to disengage catch receiver 192 from latch catch 194. Pull receiver 172 may include and/or be any of a variety of structures and/or features for operatively coupling pull accessory 50 to cap assembly 100, examples of which include a hole, an aperture, a shackle, a carabineer, a hook, a pin, etc. Similarly, pull accessory 50 may include and/or be any of a variety of structures that may be operatively coupled to cap assembly 100 via pull receiver 172 to facilitate operation of release lever 170, examples of which include a cord, a strap, a string, a tab, a flexible accessory, a rigid accessory, a semi-rigid accessory, etc.

As an example, pull accessory 50 may be particularly useful for circumstances in which the user's hands are numb and/or are experiencing reduced dexterity associated with sporting activities, and release lever 170 may become correspondingly difficult to operate. This difficulty thus may introduce a time delay in the process of transitioning cover portion 130 to the open configuration and refilling liquid vessel 20, such as during a running race. Pull accessory 50 may offer a handle that is easier to operate in such reduced dexterity situations and thereby assist in any such difficulty.

FIGS. 5-12 provide illustrative, non-exclusive examples of cap assemblies 100 that are indicated at and referred to herein as cap assembly 300 and drink containers 10 including cap assembly 300 according to the present disclosure. Where appropriate, the reference numerals from the schematic illustrations of FIGS. 1-4 are used to designate corresponding parts in FIGS. 5-12; however, the examples of FIGS. 5-12 are non-exclusive and do not limit cap assemblies 100 and/or drink containers 10 to the illustrative embodiments of FIGS. 5-12. That is, cap assemblies 100 and/or drink containers 10 may incorporate any number of the various aspects, configurations, characteristics, structures, components, properties, etc. that are illustrated and discussed herein with reference to the schematic representations of FIGS. 1-4 and/or the embodiments of FIGS. 5-12, as well as variants thereof, without requiring inclusion of all such aspects, configurations, characteristics, structures, components, properties, etc. For the purpose of brevity, each previously discussed component, part, portion, aspect, region, etc. or variants thereof may not be discussed, illustrated, and/or labelled again with respect to FIGS. 5-12; however, it is within the scope of the present disclosure that the previously discussed features, functions, variants, etc. may be utilized with the examples of FIGS. 5-12.

Figure 5:
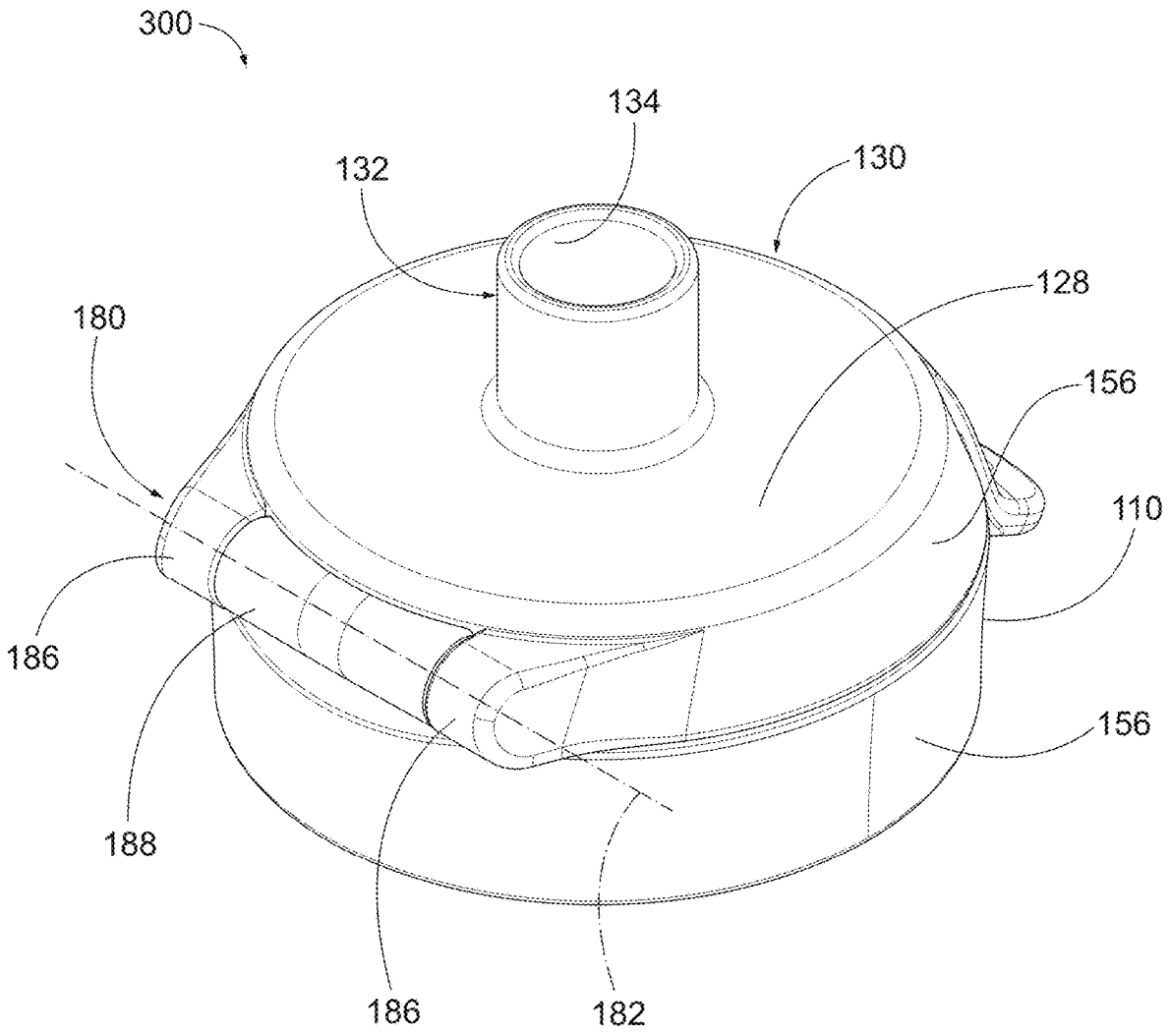
FIG. 5 is a top rear side isometric view of an example of a cap assembly with a cover portion in a closed configuration according to the present disclosure.
Figure 6:
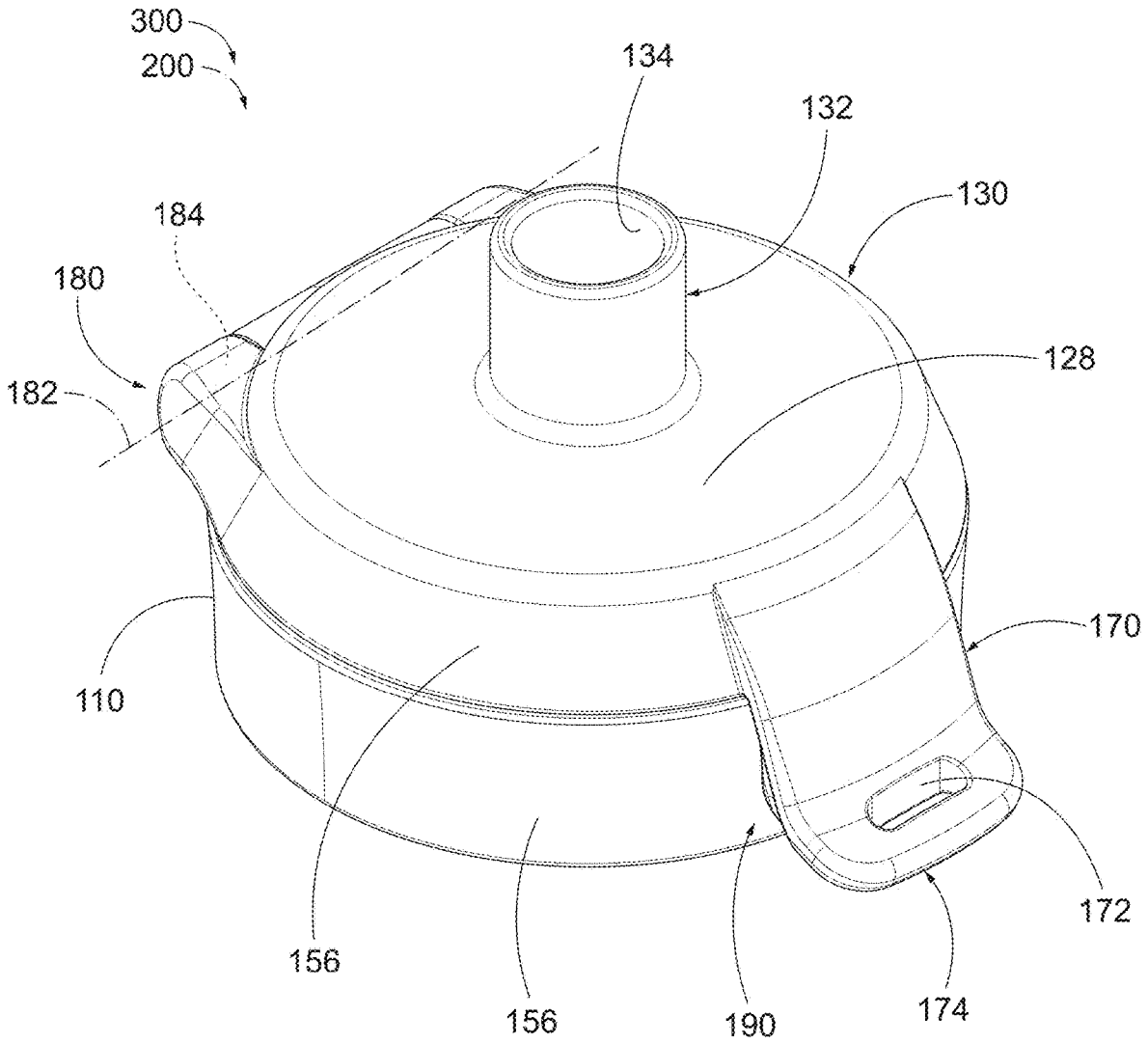
FIG. 6 is a top front side isometric view of the cap assembly of FIG. 5 with the cover portion in the closed configuration.
Figure 7:
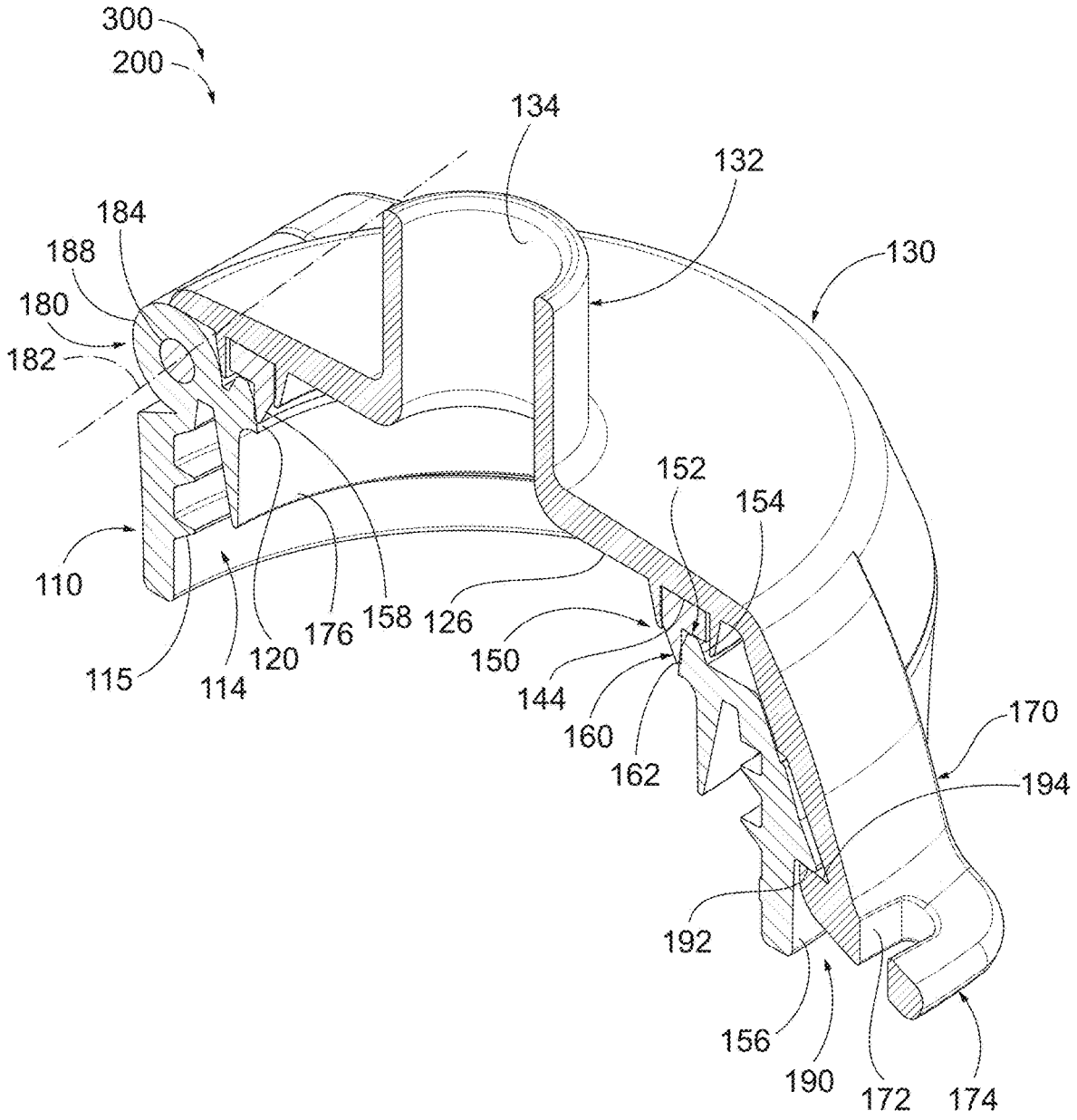
FIG. 7 is a cross-sectional top front side isometric view of the cap assembly of FIG. 5 with the cover portion in the closed configuration.
Figure 8:
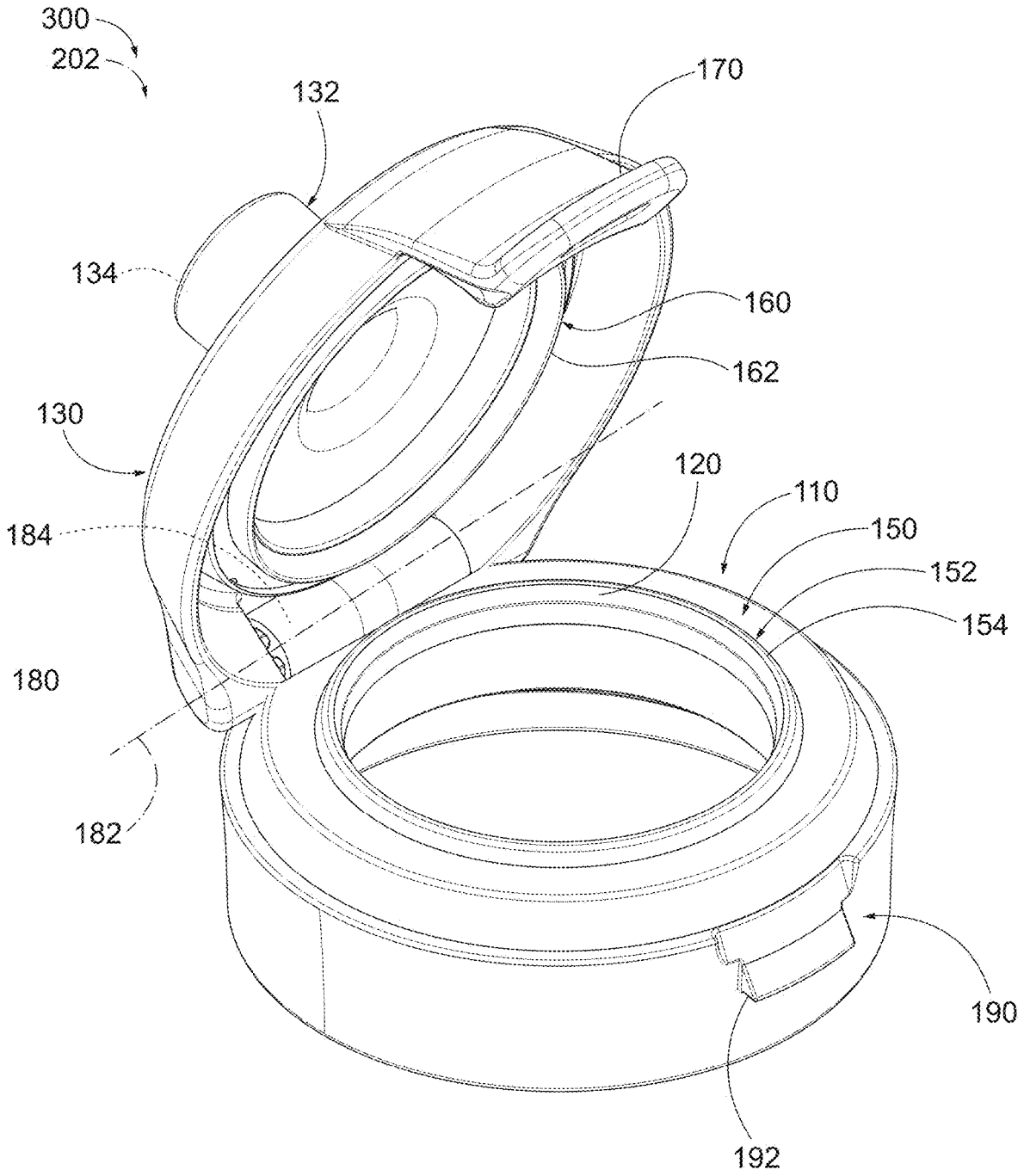
FIG. 8 is a top front side isometric view of the cap assembly of FIG. 5 with the cover portion in an open configuration according to the present disclosure.

FIGS. 5-8 illustrate examples of cap assembly 300 with cover portion 130 in closed configuration 200. More specifically, FIG. 5 is an isometric view of cap assembly 300 directed at hinge 180, FIG. 6 is an isometric view directed at closure mechanism 190, and FIG. 7 is a cross-sectional view of cap assembly 300 taken at the same viewing point as FIG. 6. FIG. 8 is an isometric view of cap assembly 300 with cover portion 130 in open configuration 202.

Generally with reference to the examples of FIGS. 5-8, cover portion 130 includes outlet spout 132 that is centered around and at least partially defines drink outlet 134. Outlet spout 132 projects outwardly from the remainder of external-facing surface 128 of cover portion 130 such that drink outlet 132 comprises a tubular channel that extends away from the remainder of external-facing surface 128. In this example, outlet spout 132 is integral with the remainder of cover portion 130. Base portion 110 includes cap coupling mechanism 114 in the form of an internally threaded collar 115 and a radially inset ridge 176. Threaded collar 115 and radially inset ridge 176 are configured to receive the neck of a liquid vessel therebetween and to form a seal with the neck.

Hinge 180 includes a pair of knuckles 186 integrally formed with cover portion 130 and a barrel 188 that is integrally formed with base portion 110 and that is positioned between knuckles 186. Hinge 180 further includes a hinge pin 184 that is mounted in knuckles 186 and that is slidingly received in a central channel in barrel 188. Knuckles 186 are configured to pivot about hinge pin 184 with respect to barrel 188 to permit cover portion 130 to transition between closed configuration 200 and open configuration 202, as shown in FIG. 8. In other words, hinge pin 184 defines pivot axis 182.

Cap assembly 100 further includes closure mechanism 190, which includes release lever 170. Release lever 170 is integrally formed with cover portion 130 and projects radially outward and downward from exterior sidewall 156 of cover portion 130. Closure mechanism 190 and release lever 170 thereof are positioned circumferentially opposed to hinge 180. Release lever 170 includes lever flange 174 that defines the distal end of release lever 170. Release lever 170 also includes pull receiver 172 in the form of a rounded rectangular slot extending through lever flange 174.

As shown in FIG. 7, closure mechanism 190 further includes latch catch 194 integrally formed with release lever 170 and projecting towards base portion 110 from release lever 170. Closure mechanism 190 also includes catch receiver 192 projecting from exterior sidewall 156 of cover portion 130 towards release lever 170. With cover portion 130 in closed configuration 200, latch catch 194 and catch receiver 192 are interlocked with one another. More specifically, catch receiver 192 includes a downwardly angled surface that engages with an opposed, upwardly angled ledge of latch catch 194. When engaged in this manner, latch catch 194 and catch receiver 192 restrict cover portion 130 from pivoting away from base portion 110 and restrict release lever 170 from pivoting away from catch receiver 192.

As further shown in FIG. 7, cap assembly 100 includes sealing structure 150. Sealing structure 150 includes a sealing lip 154 that is integrally formed with cover portion 130 and that extends circumferentially about base opening 120. Sealing structure 150 also includes sealing gasket 162 positioned and shaped to seal with sealing lip 154 about the circumference of base opening 120. Cover portion 130 includes sealing gasket receiver 144 that projects from internal-facing surface 126 of cover portion 130 and that receives sealing gasket 162. In these examples, sealing gasket 162 further includes a skirt 158 that projects downwardly to seal against a radially inward-facing surface of sealing lip 154.

As shown in FIG. 8, when cover portion 130 is in open configuration 202, cover portion 130 is pivoted about hinge 180 away from base portion 110 with catch receiver 192 disengaged from latch catch 194 and with sealing gasket 162 disengaged from sealing lip 154. In this way, base opening 120 is available for dispensing liquid into the liquid vessel.

Figure 9:
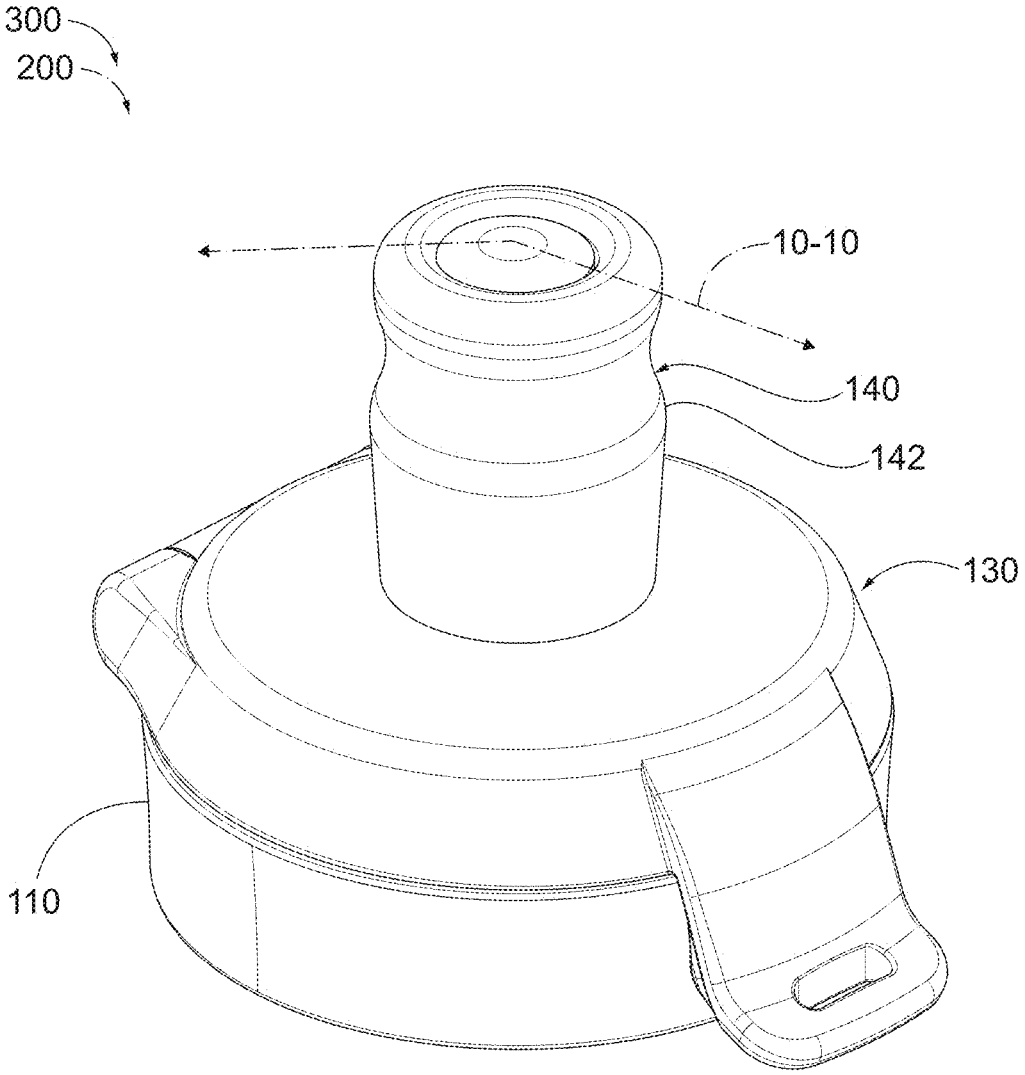
FIG. 9 is a top front side isometric view of an example of a cap assembly including an outlet valve and with the cover portion in a closed configuration according to the present disclosure.
Figure 10:
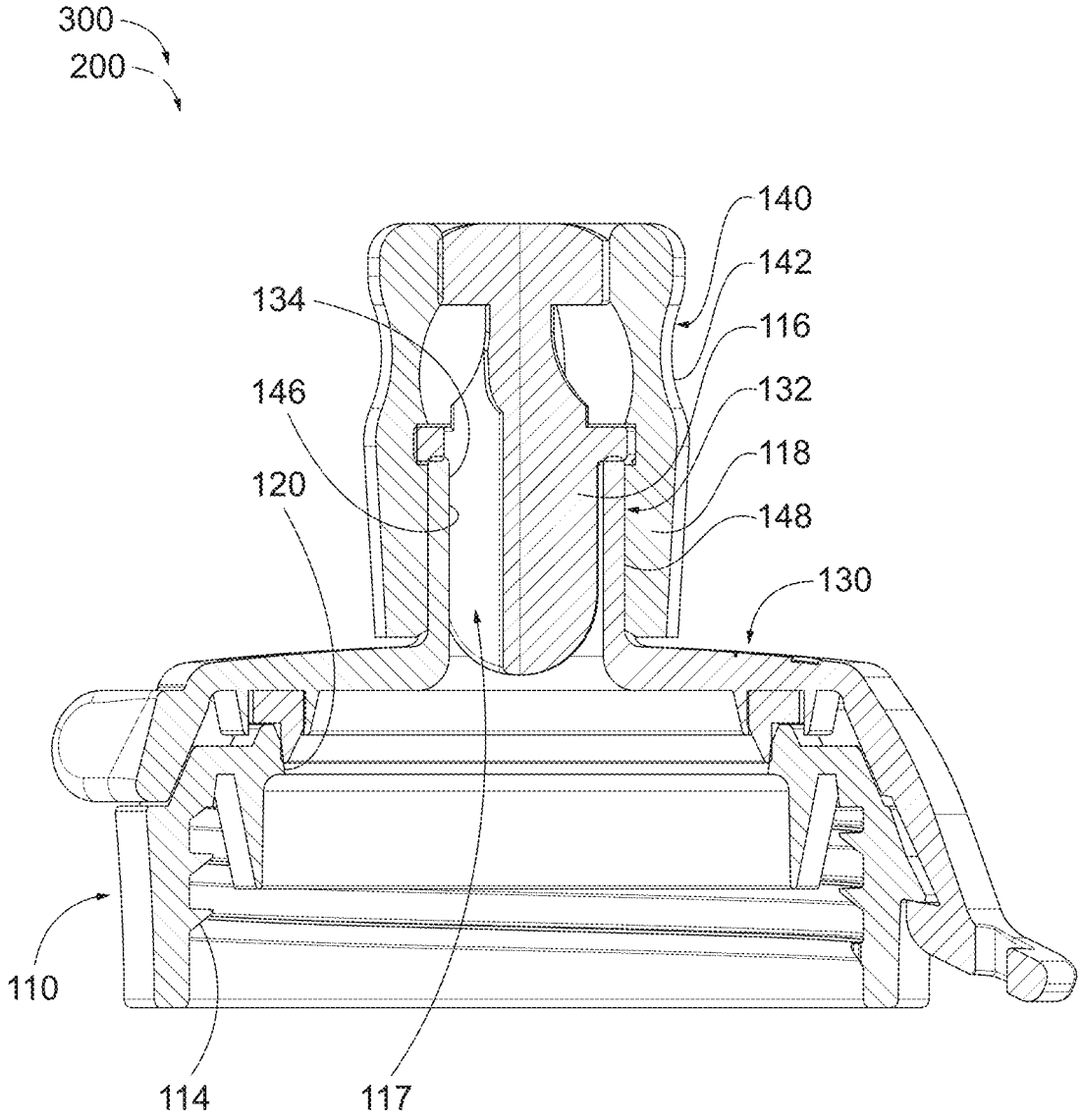
FIG. 10 is a cross-sectional side elevation view of the cap assembly of FIG. 9 with the cover portion in the closed configuration.
Figure 11:
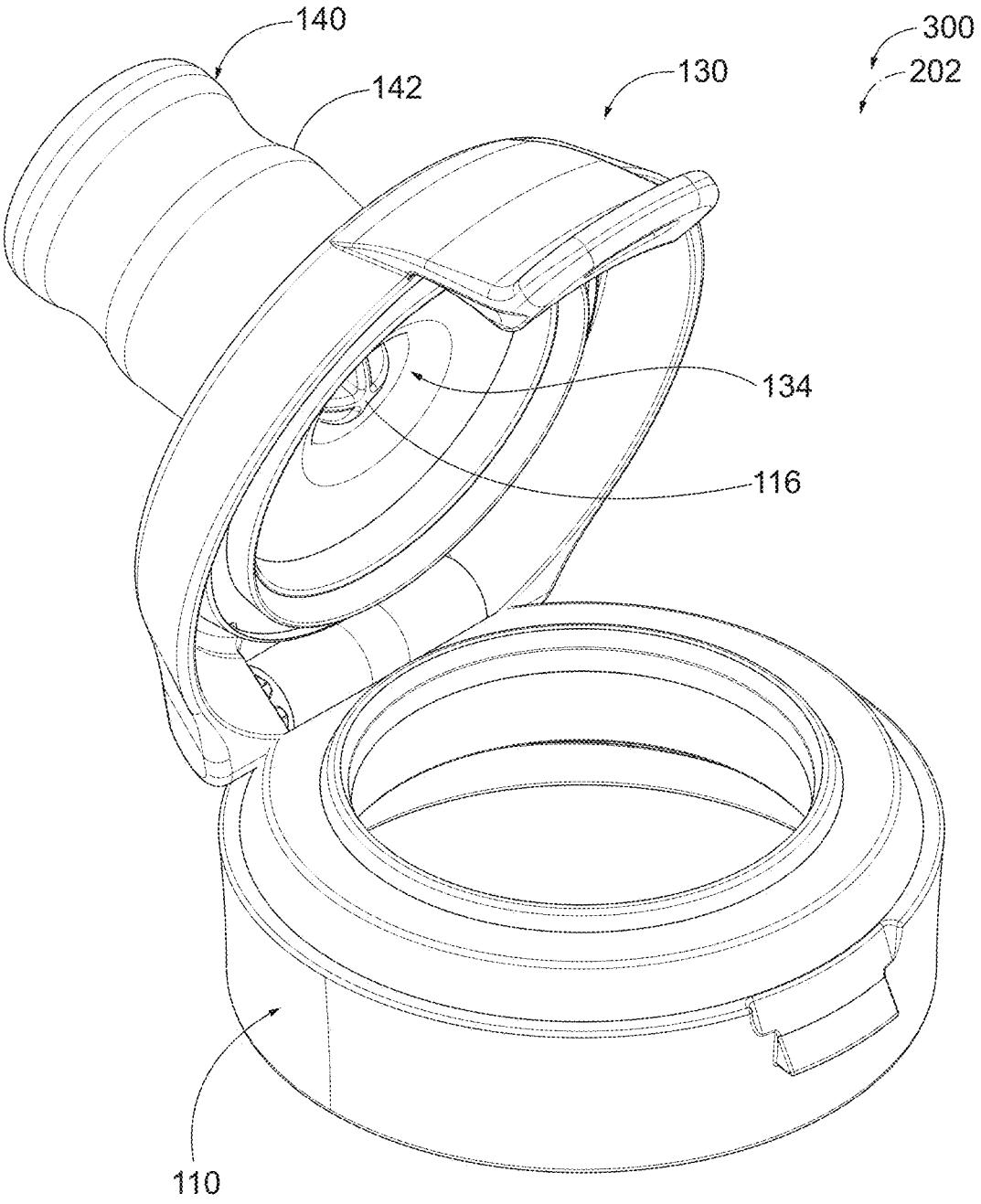
FIG. 11 is an isometric view of the cap assembly of FIG. 9 with the cover portion in an open configuration according to the present disclosure.

FIGS. 9-11 illustrate examples of cap assembly 300 coupled to outlet valve 140 according to the present disclosure. More specifically, FIG. 9 is an isometric view of cap assembly 300 coupled to outlet valve 140 with cover portion 130 in closed configuration 200, FIG. 10 is a cross-sectional view taken along line 10-10 shown in FIG. 9 of cap assembly 300 coupled to outlet valve 140 with cover portion 130 in closed configuration 200, and FIG. 11 is an isometric view of cap assembly 300 coupled to outlet valve 140 with cover portion 130 in open configuration 202.

With reference to FIGS. 9-11, outlet valve 140 is coupled to cover portion 130 via outlet spout 132. In other words, outlet spout 132 forms nozzle coupler 124, as discussed herein. In this example, outlet valve 140 is a bite valve 142. Outlet valve 140 includes female portion 118 that extends around and seals against spout exterior surface 148 of outlet spout 132. Outlet spout 132 also includes male portion 116 that extends within drink outlet 134 and engages spout interior surface 146 of outlet spout 132. Male portion 116 further includes passageways 117 that permit liquid to flow through male portion 116 when bite valve 142 is properly engaged.

Figure 12:
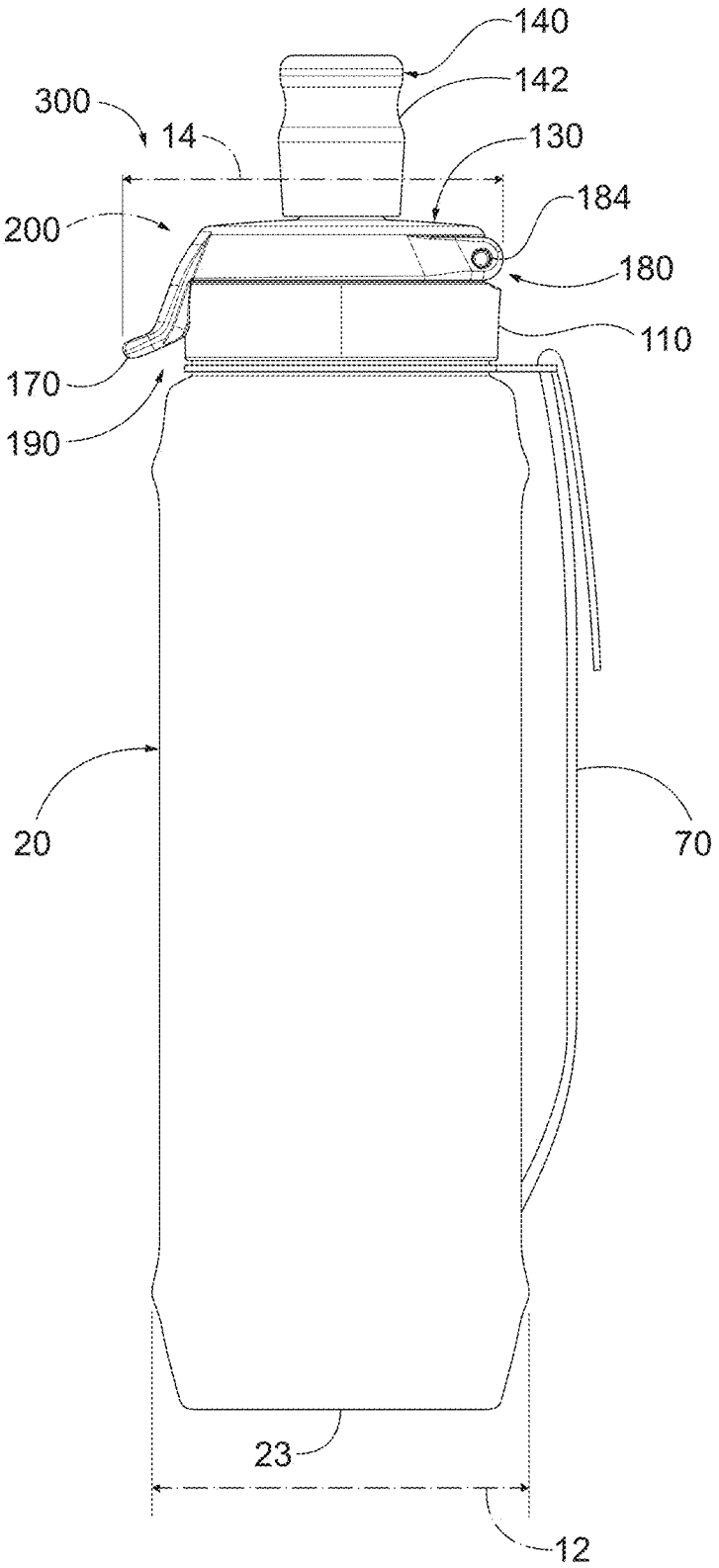
FIG. 12 is a side elevation view of an example of a drink container including a cap assembly and a drink vessel according to the present disclosure.

FIG. 12 is an elevation view showing a drink container 10 that includes cap assembly 300. More specifically, cap assembly 300 is sealingly coupled to and/or sealingly mated with the neck 22 of drink vessel 20 via cap coupling mechanism 114, as discussed herein. Cover portion 130 is maintained in closed configuration 200 by closure mechanism 190. Bite valve 142 is coupled to cover portion 130 as discussed herein. Drink vessel 20 includes hand strap 70 that is coupled at one end adjacent to neck 22 of drink vessel 20 and at its other end adjacent to the bottom surface 23 of liquid vessel 20. As discussed herein, hand strap 70 is configured to extend across at least a portion of a user's hand to at least partially retain the drink container against the user's hand during operative use of the drink container. FIG. 12 also illustrates liquid vessel maximum diameter 12 and cap assembly maximum diameter 14, as discussed herein, Illustrative, non-exclusive examples of inventive subject matter according to the present disclosure are described in the following enumerated paragraphs:

A1. A cap assembly for a drink container that includes a liquid vessel having a neck with a neck opening and having an internal compartment configured to hold a volume of potable drink liquid, the cap assembly comprising:

a base portion configured to be selectively coupled to and/or sealingly mated with the neck of the liquid vessel, wherein the base portion includes a base opening; and a cover portion including a drink outlet, wherein the cover portion is pivotally coupled to the base portion to selectively transition the cover portion between a closed configuration and an open configuration;

wherein when the cover portion is in the closed configuration with the cap assembly operatively coupled to the liquid vessel, the cover portion is configured to channel liquid to flow from the internal compartment through the base opening and to the drink outlet, wherein when the cover portion is in the closed configuration with the cap assembly operatively coupled to the liquid vessel, the cover portion restricts liquid from being dispensed from the cap assembly through the base opening other than through the drink outlet; and wherein when the cover portion is in the open configuration with the cap assembly operatively coupled to the liquid vessel, the cover portion is pivoted away from the base portion and permits liquid to be dispensed from the cap assembly through the base opening and without passing through the drink outlet.

A2. The cap assembly of paragraph A1, wherein when the cover portion is in the closed configuration with the cap assembly operatively coupled to the liquid vessel, the cover portion restricts the potable drink liquid from being introduced into or dispensed from the liquid vessel other than via the drink outlet; and wherein, when the cover portion is in the open configuration with the cap assembly operatively coupled to the liquid vessel, at least a portion of the cover portion is spaced apart from the base portion to permit the potable drink liquid to be introduced into or dispensed from the liquid vessel via the base opening without flowing through the drink outlet.

A3. The cap assembly of any of paragraphs A1-A2, wherein the base opening has a base opening diameter; wherein the drink outlet has a drink outlet diameter; and wherein a ratio of the base opening diameter to the drink outlet diameter is one or more of at least 1.5:1, at least 2:1, at least 2.5:1, at least 3:1, at least 3.5:1, at least 4:1, at least 4.5:1, at most 5:1, at most 4.25:1, at most 3.75:1, at most 3.25:1, at most 2.75:1, at most 2.25:1, and at most 1.75:1.

A4. The cap assembly of any of paragraphs A1-A3, wherein the cover portion includes an outlet spout that extends away from the base portion when the cover portion is in the closed configuration; and wherein the outlet spout defines the drink outlet.

A5. The cap assembly of paragraph A4, wherein the outlet spout is at least substantially cylindrical.

A6. The cap assembly of any of paragraphs A4-A5, wherein the outlet spout is formed of at least one of a rigid material, a semi-rigid material, a flexible material, a resiliently deformable material, a polymer, a plastic, and silicone.

A7. The cap assembly of any of paragraphs A1-A5, wherein the cap assembly further includes or is configured to be utilized in conjunction with a drink nozzle, wherein the drink nozzle is configured to at least one of channel liquid from and regulate flow of liquid through the drink outlet.

A8. The cap assembly of paragraph A7, wherein the cap assembly further includes a nozzle coupler configured to selectively couple the drink nozzle to the cover portion about, or around, the drink outlet.

A9. The cap assembly of any of paragraphs A7-A8, wherein the drink nozzle comprises an outlet valve configured to selectively restrict flow of the potable drink liquid from the drink outlet.

A10. The cap assembly of paragraph A9, wherein the outlet valve includes, and optionally is, one or more of a bite-actuated valve, a self-sealing valve, a slit diaphragm valve, a manually-actuated valve, a push-pull valve, a rotary valve, and a barrel valve.

A11. The cap assembly of any of paragraphs A9-A10, wherein the outlet valve is formed of at least one of a rigid material, a semi-rigid material, a flexible material, a resiliently deformable material, a polymer, a plastic, and silicone.

A12. The cap assembly of any of paragraphs A7-A9, wherein the outlet valve is configured to be operatively coupled to an/the outlet spout during operative use of the cap assembly, and wherein the outlet spout forms a/the nozzle coupler.

A13. The cap assembly of paragraph A10, wherein the outlet valve is configured to be selectively and repeatedly removed from and operatively coupled to the outlet spout without damage to the cap assembly.

A14. The cap assembly of any of paragraphs A9-A13, wherein the outlet valve is configured to engage the outlet spout via one or more of a friction-fit coupling, a threaded coupling, a twist-lock coupling, and a bayonet lock coupling.

A15. The cap assembly of any of paragraphs A9-A14, wherein the outlet valve is integrally formed with at least a portion of the cover portion.

A16. The cap assembly of any of paragraphs A7-A15, wherein the drink nozzle includes a drink tube attached to or configured to couple with the cover portion about the drink outlet, wherein the drink tube extends away from the cap assembly when the drink tube is attached to or coupled to the cover portion about the drink outlet.

A17. The cap assembly of paragraph A16, wherein the drink tube includes a first end that is configured to operatively couple to a/the nozzle coupler and a second end that is distal to the first end and that is configured to be coupled to an/the outlet valve, wherein the drink tube is configured to convey the potable drink liquid between the first end and the second end thereof, and wherein the outlet valve is configured to selectively restrict flow of the potable drink liquid from the second end of the drink tube.

A18. The cap assembly of paragraph A17, further comprising an/the outlet valve; wherein the outlet valve is operatively coupled to the drink tube distal the drink outlet.

A19. The cap assembly of paragraph A18, wherein the outlet valve and the drink tube are configured to interchangeably couple to a/the nozzle coupler.

A20. The cap assembly of any of paragraphs A1-A19, further comprising a sealing structure that forms a liquid-tight seal between the base portion and the cover portion when the cover portion is in the closed configuration.

A21. The cap assembly of paragraph A20, wherein the sealing structure is configured such that, when the cover portion is in the closed configuration, the sealing structure forms a seal that is liquid-tight against an internal fluid static pressure that is one or more of at least 5 pounds per square inch (psi) (34.5 kilopascals (kPa)), at least 10 psi (68.9 kPa), at least 15 psi (103.4 kPa), at most 20 psi (137.9 kPa), at most 12 psi (82.7 kPa), and at most 7 psi (48.3 kPa).

A22. The cap assembly of any of paragraphs A20-A21, wherein the base portion includes a base portion sealing surface; wherein the cover portion includes a cover portion sealing surface; wherein the sealing structure includes the base portion sealing surface and the cover portion sealing surface; and wherein, when the cover portion is in the closed configuration, the base portion sealing surface seals against the cover portion sealing surface to form the liquid-tight seal.

A23. The cap assembly of paragraph A22, wherein the base portion sealing surface includes a sealing lip extending circumferentially around the base opening and extending toward the cover portion at least when the cover portion is in the closed configuration.

A24. The cap assembly of any of paragraphs A22-A23, wherein the cover portion sealing surface extends circumferentially around the base opening when the cover portion is in the closed configuration.

A25. The cap assembly of any of paragraphs A22-A24, wherein the cover portion sealing surface includes a sealing gasket.

A26. The cap assembly of paragraph A25, wherein the sealing gasket is configured to resiliently deform when the base portion sealing surface seals against the sealing gasket.

A27. The cap assembly of any of paragraphs A25-A26, wherein the cover portion includes a sealing gasket receiver, and wherein the cover portion sealing surface is at least partially received within the sealing gasket receiver during operative use of the cap assembly.

A28. The cap assembly of paragraph A27, wherein the sealing gasket receiver includes one or more of a groove, a channel, and a recess.

A29. The cap assembly of any of paragraphs A25-A28, wherein the sealing gasket is frictionally received within the sealing gasket receiver during operative use of the cap assembly.

A30. The cap assembly of any of paragraphs A25-A29, wherein the sealing gasket is configured to be selectively and repeatedly removed from and replaced into the sealing gasket receiver without damage to the sealing gasket and the sealing gasket receiver.

A31. The cap assembly of any of paragraphs A1-A30, wherein the cap assembly further comprises a hinge that operatively couples the cover portion to the base portion such that the cover portion is configured to pivot relative to the base portion to transition the cover portion between the closed configuration and the open configuration.

A31.1. The cap assembly of paragraph A31, wherein the hinge couples the cover portion to the base portion such that the cover portion is configured to pivot relative to the base portion about a pivot axis to transition the cover portion between the closed configuration and the open configuration.

A32. The cap assembly of any of paragraphs A1-A31.1, wherein the hinge constrains the cover portion to travel along a predefined cover path as the cover portion transitions between the closed configuration and the open configuration.

A33. The cap assembly of any of paragraphs A1-A32, wherein the hinge constrains the cover portion to travel along a cover path that extends within a predefined cover path plane as the cover portion transitions between the closed configuration and the open configuration.

A34. The cap assembly of any of paragraphs A1-A33, wherein the pivot axis extends at least partially through each of the base portion and the cover portion.

A35. The cap assembly of any of paragraphs A1-A34, wherein the hinge includes a hinge pin that extends along the pivot axis.

A36. The cap assembly of paragraph A35, wherein the hinge pin extends at least partially through each of the base portion and the cover portion.

A37. The cap assembly of any of paragraphs A1-A36, wherein the pivot axis remains nominally fully stationary relative to one, and optionally both, of the base portion and the cover portion as the cover portion transitions between the closed configuration and the open configuration.

A38. The cap assembly of any of paragraphs A1-A37, wherein the pivot axis shifts relative to one or both of the base portion and the cover portion as the cover portion transitions between the closed configuration and the open configuration.

A39. The cap assembly of any of paragraphs A1-A38, wherein the hinge includes, and optionally is, a living hinge.

A40. The cap assembly of any of paragraphs A1-A39, wherein a portion of the hinge is integrally formed with the base portion.

A41. The cap assembly of any of paragraphs A1-A40, wherein a portion of the hinge is integrally formed with the cover portion.

A42. The cap assembly of any of paragraphs A1-A41, wherein, when the cover portion is in the open configuration, the hinge is configured to one or both of:

(i) at least partially restrict the cover portion from pivoting relative to the base portion; and (ii) at least partially retain the cover portion in the open configuration.

A43. The cap assembly of any of paragraphs A1-A42, further comprising a closure mechanism configured to selectively maintain the cover portion in the closed configuration.

A44. The cap assembly of paragraph A43, wherein the closure mechanism is configured to transition between an engaged configuration, in which the closure mechanism maintains the cover portion in the closed configuration, and a disengaged configuration, in which the cover portion is free to transition from the closed configuration to the open configuration.

A45. The cap assembly of paragraph A44, wherein the closure mechanism is biased toward the engaged configuration at least when the cover portion is in the closed configuration.

A46. The cap assembly of any of paragraphs A44-A45, wherein the closure mechanism is configured to transition to the engaged configuration automatically when the cover portion transitions from the open configuration to the closed configuration.

A47. The cap assembly of any of paragraphs A44-A46, wherein the closure mechanism includes a lock mechanism configured to selectively retain the closure mechanism in the engaged configuration.

A48. The cap assembly of paragraph A47, wherein the lock mechanism includes one or more of a twist-lock mechanism, a slide-lock mechanism, and a cam-lock mechanism.

A49. The cap assembly of any of paragraphs A43-A48, wherein the closure mechanism includes an over-center cam lock.

A50. The cap assembly of any of paragraphs A43-A49, wherein the closure mechanism includes a latch catch and a catch receiver configured to engage the latch catch when the cover portion is in the closed configuration and when the closure mechanism is in an/the engaged configuration; wherein one of the base portion and the cover portion includes the latch catch; and wherein the other of the base portion and the cover portion includes the catch receiver.

A51. The cap assembly of paragraph A50, wherein the closure mechanism further comprises a release lever operatively coupled to the cover portion; wherein the release lever includes the latch catch; and wherein the release lever is configured to be selectively moved away from the catch receiver to transition the closure mechanism from the engaged configuration to the disengaged configuration.

A52. The cap assembly of paragraph A51, wherein, when the cover portion is in the closed configuration, the release lever is biased toward the catch receiver to bias the closure mechanism toward the engaged configuration.

A53. The cap assembly of any of paragraphs A51-A52, wherein the release lever is integrally formed with at least a portion of the cover portion.

A54. The cap assembly of any of paragraphs A51-A52, wherein the release lever is one or both of pivotally coupled to the cover portion and hingedly coupled to the cover portion.

A55. The cap assembly of any of paragraphs A51-A54, wherein the release lever defines a pull receiver for selectively coupling a pull accessory to the cap assembly to facilitate transitioning the closure mechanism from the engaged configuration to the disengaged configuration.

A56. The cap assembly of paragraph A55, wherein the pull receiver includes, and optionally is, one or more of a hole, an aperture, a shackle, a carabiner, a hook, and a pin.

A57. The cap assembly of any of paragraphs A55-A56, wherein the pull accessory includes, and optionally is, one or more of a cord, a strap, a string, a tab, a flexible accessory, a rigid accessory, and a semi-rigid accessory.

A58. The cap assembly of any of paragraphs A1-A57, wherein the base portion includes at least a portion of a cap coupling mechanism configured to selectively couple the cap assembly to the liquid vessel.

A59. The cap assembly of paragraph A58, wherein the cap coupling mechanism is configured to selectively couple the cap assembly to the liquid vessel at least partially via a threaded coupling.

A60. The cap assembly of any of paragraphs A58-A59, wherein the cap coupling mechanism is configured to selectively couple the cap assembly to the liquid vessel at least partially via a friction-fit coupling.

B1. A drink container, comprising:

a liquid vessel having a neck with a neck opening and having an internal compartment configured to hold a volume of potable drink liquid; and the cap assembly of any of paragraphs A1-A60 configured to be selectively and operatively coupled to the neck of the liquid vessel.

B2. The drink container of paragraph B1, wherein the liquid vessel is a semi-rigid liquid vessel configured to be squeezed by a user to expel the potable drink liquid through the cap assembly.

B3. The drink container of paragraph B2, wherein the semi-rigid liquid vessel is configured to permit opposed portions of the liquid vessel to be moved from a nominal configuration toward each other when the liquid vessel is squeezed by a user, and further wherein the liquid vessel automatically returns to the nominal configuration when the opposed portions cease to be squeezed.

B4. The drink container of any of paragraphs B2-B3, wherein the semi-rigid liquid vessel is resiliently deformable from a nominal configuration to a partially collapsed configuration responsive to a user squeezing opposed portions of the liquid vessel.

B5. The drink container of paragraph B1, wherein the liquid vessel is a rigid liquid vessel.

B6. The drink container of any of paragraphs B1-B2, wherein the liquid vessel is a collapsible liquid vessel that is configured to non-resiliently collapse as liquid is dispensed from the liquid vessel.

B7. The drink container of any of paragraphs B1-B6, wherein the liquid vessel is a/the collapsible liquid vessel that is configured to deflate as liquid is dispensed from the liquid vessel.

B8. The drink container of any of paragraphs B1-B7, wherein the neck includes at least a portion of a/the cap coupling mechanism configured to selectively couple the cap assembly to the liquid vessel.

B9. The drink container of paragraph B8, wherein the cap coupling mechanism includes threads on the neck and threads on the base portion that matingly engage one another to operatively couple the cap assembly to the liquid vessel.

B10. The drink container of any of paragraphs B1-B 9, wherein the internal compartment has an internal volume that is one or more of at least 125 milliliters (mL), at least 150 mL, at least 200 mL, at least 300 mL, at least 400 mL, at least 500 mL, at least 750 mL, at least 1 liter (L), at least 1.5 L, at most 2 L, at most 1.2 L, at most 800 mL, at most 600 mL, at most 450 mL, at most 350 mL, at most 250 mL, at most 175 mL, and at most 140 mL.

B11. The drink container of any of paragraphs B1-B10, wherein the liquid vessel includes an inner vessel surface that at least partially defines the internal compartment and an outer vessel surface configured to be gripped by a user.

B12. The drink container of paragraph B11, wherein the outer vessel surface is at least partially spaced apart from the inner vessel surface.

B13. The drink container of any of paragraphs B11-B12, wherein the outer vessel surface includes a grip feature configured to facilitate gripping of the drink container by a user's hand.

B14. The drink container of paragraph B13, wherein the grip feature includes, and optionally is, a textured region of the outer vessel surface.

B15. The drink container of any of paragraphs B13-B14, wherein the grip feature includes a material selected to yield an increased coefficient of friction between the user's hand and the grip feature relative to a coefficient of friction between the user's hand and a portion of the outer vessel surface apart from the grip feature.

B16. The drink container of any of paragraphs B1-B15, further comprising a hand strap configured to extend across at least a portion of a/the user's hand to at least partially retain the drink container against the user's hand during operative use of the drink container.

B17. The drink container of paragraph B16, wherein the hand strap is one or both of elastic and selectively adjustable.

B18. The drink container of any of paragraphs B1-B17, wherein the liquid vessel includes an insulation layer configured to restrict a transfer of heat energy through the liquid vessel.

B19. The drink container of paragraph B18, wherein the insulation layer includes at least one of a foam, an open-cell foam, a metallic foil, a fluid, a gas, and a liquid.

B20. The drink container of any of paragraphs B18-B19, wherein the insulation layer is positioned between a/the inner vessel surface and a/the outer vessel surface.

B21. The drink container of any of paragraphs B18-B20, wherein the insulation layer is formed on at least one of a/the inner vessel surface and a/the outer vessel surface.

B22. The drink container of any of paragraphs B18-B21, wherein the insulation layer is adhered to at least one of a/the inner vessel surface and a/the outer vessel surface.

B23. The drink container of any of paragraphs B18-B22, wherein the insulation layer is at least one of optically transparent and optically translucent.

B24. The drink container of any of paragraphs B18-B23, wherein the insulation layer is at least substantially opaque.

B25. The drink container of any of paragraphs B1-B24, wherein the liquid vessel has a liquid vessel maximum diameter; and wherein the cap assembly has a cap assembly maximum diameter that is one or more of at most 125% of the liquid vessel maximum diameter, at most 120% of the liquid vessel maximum diameter, at most 110% of the liquid vessel maximum diameter, at most 100% of the liquid vessel maximum diameter, at most 90% of the liquid vessel maximum diameter, at most 80% of the liquid vessel maximum diameter, and at least 70% of the liquid vessel maximum diameter.

B26. The drink container of any of paragraphs B1-B25, wherein the cap assembly is operatively coupled to the liquid vessel such that at least a portion of the cap assembly is not configured to be removed from the liquid vessel without damage to the cap assembly and/or to the liquid vessel.

B27. The drink container of paragraph B26, wherein the cover portion is operatively coupled to one or both of the neck of the liquid vessel and a wall of the liquid vessel that is proximate to the neck opening of the liquid vessel.

B28. The drink container of any of paragraphs B26-B27, wherein the cover portion is hingedly coupled to the liquid vessel, optionally via the hinge.

B29. The drink container of any of paragraphs B26-B28, wherein the liquid vessel forms at least a portion of the hinge.

B30. The drink container of any of paragraphs B26-B28, wherein the liquid vessel includes a portion of a/the sealing structure; optionally wherein the liquid vessel includes at least a portion of a/the base portion sealing surface.

B31. The drink container of any of paragraphs B26-B30, wherein the liquid vessel includes at least a portion of the base portion.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

As used herein, the term "and/or" placed between a first entity and a second entity means one of (1) the first entity, (2) the second entity, and (3) the first entity and the second entity. Multiple entries listed with "and/or" should be construed in the same manner, i.e., "one or more" of the entities so conjoined. Other entities optionally may be present other than the entities specifically identified by the "and/or" clause, whether related or unrelated to those entities specifically identified. Thus, as a non-limiting example, a reference to "A and/or B," when used in conjunction with open-ended language such as "comprising," may refer, in one example, to A only (optionally including entities other than B); in another example, to B only (optionally including entities other than A); in yet another example, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

As used herein, the phrase "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, a first component that extends at least substantially around a second component includes a first component that extends around at least 75% of a circumference of the second component and also includes a first component that extends fully circumferentially around the second component.

As used herein, the phrase "nominally fully," when modifying a degree or relationship, includes the full extent of the recited degree or relationship as well as degrees or relationships that differ from the full extent of the recited degree or relationship by up to 1%. For example, a first direction that is nominally fully parallel to a second direction includes a first direction that is within an angular deviation of 0.9° relative to the second direction and also includes a first direction that is identical to the second direction. In this manner, the phrase "nominally fully" may be substituted in place of the phrase "at least substantially." Stated differently, as used herein, the phrase "at least substantially" is intended to encompass degrees or relationships that are described with the phrase "nominally fully."

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

The various disclosed elements of apparatuses disclosed herein are not required to all apparatuses according to the present disclosure, and the present disclosure includes all novel and non-obvious combinations and subcombinations of the various elements disclosed herein. Moreover, one or more of the various elements disclosed herein may define independent inventive subject matter that is separate and apart from the whole of a disclosed apparatus. Accordingly, such inventive subject matter is not required to be associated with the specific apparatuses that are expressly disclosed herein, and such inventive subject matter may find utility in apparatuses and/or methods that are not expressly disclosed herein.

INDUSTRIAL APPLICABILITY

The cap assemblies and drink containers disclosed herein are applicable to the personal hydration industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, when the disclosure or subsequently filed claims recite "a" or "a first" element or the equivalent thereof, such disclosure and/or claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A cap assembly for a drink container that includes a liquid vessel having a neck with a neck opening and having an internal compartment configured to hold a volume of potable drink liquid, the cap assembly comprising:

a base portion configured to sealingly mate with the neck of the liquid vessel and including a base opening; wherein the base portion is configured to be selectively and repeatedly coupled to and decoupled from the neck of the liquid vessel without damage or destruction to the base portion or the neck of the liquid vessel;

a cover portion including a drink outlet and pivotally coupled to the base portion to selectively transition the cover portion between a closed configuration and an open configuration; and a closure mechanism configured to selectively maintain the cover portion in the closed configuration, wherein the closure mechanism is configured to transition between an engaged configuration, in which the closure mechanism maintains the cover portion in the closed configuration, and a disengaged configuration, in which the cover portion is free to transition from the closed configuration to the open configuration; wherein the closure mechanism includes a latch catch and a catch receiver configured to engage the latch catch when the cover portion is in the closed configuration and when the closure mechanism is in the engaged configuration; wherein one of the base portion and the cover portion includes the latch catch; and wherein the other of the base portion and the cover portion includes the catch receiver;

a sealing structure that forms a liquid-tight seal between the base portion and the cover portion when the cover portion is in the closed configuration and the closure mechanism is in the engaged configuration; wherein the sealing structure is distinct and spaced apart from the latch catch and the catch receiver of the closure mechanism;

a hinge that operatively couples the cover portion to the base portion such that the cover portion is configured to pivot relative to the base portion about a pivot axis to transition the cover portion between the closed configuration and the open configuration when the closure mechanism is in the disengaged configuration; and wherein when the cover portion is in the closed configuration with the cap assembly operatively coupled to the liquid vessel and the closure mechanism in the engaged configuration, the cover portion is configured to channel liquid to flow from the internal compartment through the base opening and to the drink outlet, wherein when the cover portion is in the closed configuration with the cap assembly operatively coupled to the liquid vessel and the closure mechanism in the engaged configuration, the cover portion restricts liquid from being dispensed from the cap assembly through the base opening other than through the drink outlet; wherein when the cover portion is in the closed configuration with the cap assembly operatively coupled to the liquid vessel and when the closure mechanism is in the engaged configuration, the cover portion permits liquid to be dispensed from the cap assembly only through the drink outlet; and wherein when the cover portion is in the open configuration with the cap assembly operatively coupled to the liquid vessel and the closure mechanism in the disengaged configuration, the cover portion is pivoted away from the base portion and permits liquid to be dispensed from the cap assembly through the base opening and without passing through the drink outlet.

2. The cap assembly of claim 1, wherein when the cover portion is in the closed configuration with the cap assembly operatively coupled to the liquid vessel, the cover portion restricts the potable drink liquid from being introduced into or dispensed from the liquid vessel other than via the drink outlet; and wherein when the cover portion is in the open configuration with the cap assembly operatively coupled to the liquid vessel, at least a portion of the cover portion is spaced apart from the base portion to permit the potable drink liquid to be introduced into or dispensed from the liquid vessel via the base opening without flowing through the drink outlet.

3. The cap assembly of claim 1, wherein the cap assembly further includes a drink nozzle configured to be selectively and operatively coupled to the cover portion; wherein the drink nozzle is configured to at least one of channel liquid from the drink outlet and regulate flow of liquid through the drink outlet; and wherein the drink nozzle is further configured to selectively restrict liquid from being dispensed through the drink outlet.

4. The cap assembly of claim 3, wherein the cap assembly further includes a nozzle coupler that is configured to selectively couple the drink nozzle to the cover portion about the drink outlet.

5. The cap assembly of claim 3, wherein the drink nozzle includes an outlet valve configured to selectively restrict flow of the potable drink liquid from the drink outlet.

6. The cap assembly of claim 5, wherein the cover portion includes an outlet spout that extends away from the base portion when the cover portion is in the closed configuration, wherein the outlet spout defines the drink outlet, and wherein the outlet valve is configured to be operatively coupled to the outlet spout during operative use of the cap assembly.

7. The cap assembly of claim 3, wherein the drink nozzle includes a drink tube, wherein the drink tube includes a first end that is attached to or configured to couple with the cover portion about the drink outlet, and a second end that is distal to the first end and that is attached to or configured to couple with an outlet valve, wherein the drink tube is configured to convey the potable drink liquid between the first end and the second end thereof, and wherein the outlet valve is configured to selectively restrict flow of the potable drink liquid from the second end of the drink tube.

8. The cap assembly of claim 1, wherein the base portion includes a base portion sealing surface, wherein the cover portion includes a cover portion sealing surface, wherein the sealing structure includes the base portion sealing surface and the cover portion sealing surface, and wherein, when the cover portion is in the closed configuration, the base portion sealing surface seals against the cover portion sealing surface to form the liquid-tight seal.

9. The cap assembly of claim 8, wherein the base portion sealing surface includes a sealing lip extending circumferentially around the base opening and extending toward the cover portion at least when the cover portion is in the closed configuration, wherein the cover portion sealing surface extends circumferentially around the base opening when the cover portion is in the closed configuration, and wherein the cover portion sealing surface includes a sealing gasket.

10. The cap assembly of claim 1, wherein the hinge includes a hinge pin that extends along the pivot axis, and wherein the hinge pin extends at least partially through each of the base portion and the cover portion.

11. The cap assembly of claim 1, wherein the hinge constrains the cover portion to travel along a cover path that extends within a predefined cover path plane as the cover portion transitions between the closed configuration and the open configuration.

12. The cap assembly of claim 1, wherein the closure mechanism further comprises a release lever operatively coupled to the cover portion; wherein the release lever includes the latch catch; and wherein the release lever is configured to be selectively moved away from the catch receiver to transition the closure mechanism from the engaged configuration to the disengaged configuration.

13. The cap assembly of claim 1, wherein the base portion includes at least a portion of a cap coupling mechanism configured to selectively couple the cap assembly to the neck of the liquid vessel.

14. A drink container, comprising:

a liquid vessel having a neck with a neck opening and having an internal compartment configured to hold a volume of potable drink liquid; and the cap assembly of claim 1 configured to be selectively and repeatably operatively coupled to and decoupled from the neck of the liquid vessel without damage or destruction to the base portion or the neck of the liquid vessel.

15. The drink container of claim 14, wherein the liquid vessel is a semi-rigid liquid vessel configured to be squeezed by a user to expel the potable drink liquid through the cap assembly.

16. The drink container of claim 15, wherein the liquid vessel has a liquid vessel maximum diameter; and wherein the cap assembly has a cap assembly maximum diameter that is at most 125% of the liquid vessel maximum diameter and at least 70% of the liquid vessel maximum diameter.

* * * * *